US010676925B2

(12) United States Patent
Baxter et al.

(10) Patent No.: US 10,676,925 B2
(45) Date of Patent: Jun. 9, 2020

(54) CEILING SYSTEM HAVING A PLURALITY OF DIFFERENT PANELS

(71) Applicant: ARMSTRONG WORLD INDUSTRIES, INC., Lancaster, PA (US)

(72) Inventors: Nathan J Baxter, Lancaster, PA (US); Samuel D Pawlak, Lancaster, PA (US); Scott D Harnish, Lancaster, PA (US); Ryan D Hanuschak, Lancaster, PA (US); Nicholas J Friez, Lancaster, PA (US); Nathan H Canfijn, Lancaster, PA (US); Marie A DePaul, West Chester, PA (US); Kain A Place, Lancaster, PA (US)

(73) Assignee: AWI Licensing LLC, Wilmington, DE (US)

( * ) Notice: Subject to any disclaimer, the term of this patent is extended or adjusted under 35 U.S.C. 154(b) by 0 days.

(21) Appl. No.: 16/359,481

(22) Filed: Mar. 20, 2019

(65) Prior Publication Data

US 2019/0292780 A1 Sep. 26, 2019

Related U.S. Application Data

(60) Provisional application No. 62/645,990, filed on Mar. 21, 2018.

(51) Int. Cl.
*E04B 9/00* (2006.01)
*E04B 9/12* (2006.01)

(52) U.S. Cl.
CPC ..... *E04B 9/003* (2013.01); *E04B 9/12* (2013.01)

(58) Field of Classification Search
CPC . E04B 9/003; E04B 9/12; E04B 9/068; E04B 9/127
See application file for complete search history.

(56) References Cited

U.S. PATENT DOCUMENTS

D22,273 S * 3/1893 Grafton ..... E04B 9/0478 D25/143
3,321,877 A 5/1967 Alexieff
3,685,235 A * 8/1972 Lang ..... A47H 1/04 52/39

(Continued)

FOREIGN PATENT DOCUMENTS

CA 2279150 C 12/2003
JP 09004113 A * 1/1997
WO WO 2006/135193 A1 12/2006

OTHER PUBLICATIONS

Search Report and Written Opinion for PCT/US2019/023212 (12 pages) (Year: 2019).*

*Primary Examiner* — Rodney Mintz
(74) *Attorney, Agent, or Firm* — Craig M. Sterner

(57) ABSTRACT

A ceiling system is provided for use in a building space having a plurality of walls. The ceiling system includes a grid system that extends to at least two of the plurality of walls and separates the building space into an occupiable space below the grid system and a plenum space above the grid system; and a plurality of ceiling tiles that are supported by the grid system and, with the grid system, create a barrier between the occupiable space and the plenum space, the plurality of ceiling tiles including three different polygonal non-rectangular ceiling tiles.

19 Claims, 24 Drawing Sheets

(56) References Cited

U.S. PATENT DOCUMENTS

| | | | | | |
|---|---|---|---|---|---|
| 3,742,674 | A * | 7/1973 | Lang | A47H 1/04 | 52/666 |
| 4,335,558 | A | 6/1982 | Caldwell et al. | | |
| 4,959,942 | A * | 10/1990 | Olewska | E04H 1/1272 | 52/745.02 |
| 5,241,799 | A * | 9/1993 | Jahn | E04B 9/345 | 52/28 |
| 5,406,763 | A | 4/1995 | Al-Saleh | | |
| 6,748,713 | B2 * | 6/2004 | See | E04B 9/06 | 52/22 |
| 6,782,670 | B2 | 8/2004 | Wendt | | |
| 7,637,688 | B2 | 12/2009 | Riccobene | | |
| D612,066 | S * | 3/2010 | Waters | D25/58 | |
| D612,067 | S * | 3/2010 | Waters | D25/58 | |
| 8,079,192 | B2 * | 12/2011 | Gerkes | E04B 9/14 | 52/506.06 |
| 8,474,200 | B2 * | 7/2013 | Gerkes | E04B 9/006 | 52/220.6 |
| 9,879,424 | B1 * | 1/2018 | Underkofler | E04B 9/006 | |
| 2003/0121227 | A1 * | 7/2003 | Wendt | E04B 9/0478 | 52/506.07 |
| 2004/0065037 | A1 * | 4/2004 | See | E04B 9/06 | 52/506.06 |
| 2009/0308013 | A1 * | 12/2009 | Miklosz | E04B 9/068 | 52/506.06 |
| 2011/0219718 | A1 * | 9/2011 | Gerkes | E04B 9/14 | 52/506.08 |
| 2012/0186175 | A1 * | 7/2012 | Gerkes | E04B 9/006 | 52/220.6 |
| 2017/0073968 | A1 * | 3/2017 | Kilian | E04B 9/225 | |

* cited by examiner

CEILING SYSTEM HAVING A PLURALITY OF DIFFERENT PANELS

CROSS-REFERENCE TO RELATED APPLICATIONS

This application is a claims the benefit of U.S. Provisional Application No. 62/645,990, filed on Mar. 21, 2018. The disclosure of the above application(s) is (are) incorporated herein by reference.

FIELD

The present invention relates to building panel systems. Particular embodiments of the invention relate to ceiling systems having removable panels. The removable panels can include a plurality of different shapes, colors, and/or textures.

BACKGROUND

Many types of ceiling systems and ceiling panels exist. Some ceiling systems include a grid system and lay in ceiling tiles that are supported by the grid system. These grid systems can have a plurality of metal or plastic main beams and a plurality of metal or plastic cross members that span the gaps between the main beams.

A problem exists in that these grid systems with lay in ceiling tiles can be restrictive in that the possible visual appearances that can be created are limited.

Accordingly, embodiments of the invention provide ceiling systems that allow more creativity and less restriction due to the use of multiple different tiles and the use of grid systems that permit the use of multiple different tiles.

SUMMARY

Embodiments of the invention provide a solution to the above problem by allowing more flexibility in grid design and more flexibility in ceiling tile construction and arrangement.

In one aspect, a ceiling system is for use in a building space having a plurality of walls. The ceiling system includes a grid system that extends to at least two of the plurality of walls and separates the building space into an occupiable space below the grid system and a plenum space above the grid system; and a plurality of ceiling tiles that are supported by the grid system and, with the grid system, create a barrier between the occupiable space and the plenum space, the plurality of ceiling tiles including three different polygonal non-rectangular ceiling tiles.

In another aspect, the plenum space is a closed space.

In another aspect, a difference in the three different polygonal non-rectangular ceiling tiles is shape.

In another aspect, a difference in the three different polygonal non-rectangular ceiling tiles is color.

In another aspect, a difference in the three different polygonal non-rectangular ceiling tiles is shade of the same color.

In another aspect, a difference in the three different polygonal non-rectangular ceiling tiles is size.

In another aspect, a difference in the three different polygonal non-rectangular ceiling tiles is texture.

In another aspect, two of the three different ceiling tiles are different sizes of a first shape, and a third of the three different ceiling tiles is a second shape that is different from the first shape.

In another aspect, two of the three different ceiling tiles are different shades of a first color, and a third of the three different ceiling tiles is a second color that is different from the first color.

In another aspect, the grid system has a first main beam, a second main beam parallel to the first main beam, the first and second main beams extending longitudinally in a main beam direction, a field area having a plurality of field area cross members that attach to the main beams, the field area cross members intersecting the main beams at a first angle, the first angle being an acute angle, and a perimeter area that surrounds the field area, the perimeter area having a plurality of perimeter area cross members that attach to the main beams, the perimeter area cross members intersecting the main beams at a second angle, the second angle and the first angle being different.

In another aspect, the second angle is a right angle.

In another aspect, all the perimeter area cross members are parallel to each other.

In another aspect, all the field area cross members are parallel to each other.

In another aspect, one of the ceiling tiles has a front face that faces the occupiable space and a back face that faces the plenum space, and the front face and the back face are different colors.

In another aspect, a portion of the ceiling tiles are tegular ceiling tiles.

In another aspect, the tegular ceiling tiles have a recess along their entire perimeter such that a support surface is parallel to the front face and an edge extends between the front face and the support surface, and the front face, the edge, and the support surface are all the same color.

In one aspect, a ceiling system for use in a building space having a plurality of walls, the ceiling system includes a grid system that extends to at least two of the plurality of walls and separates the building space into an occupiable space below the grid system and a plenum space above the grid system, the grid system has a first main beam, a second main beam parallel to the first main beam, the first and second main beams extending longitudinally in a main beam direction, a first cross member that interests the first main beam at a first location and intersects the second main beam at a second location, and a second cross member that intersects the second main beam at a third location, the third location being offset from the second location along the main beam direction; and a plurality of ceiling tiles that are supported by the grid system and, with the grid system, create a barrier between the occupiable space and the plenum space. All cross members that intersect the second main beam at the second location are on a side of the second main beam that faces the first main beam, and at least one of the first cross member and the second cross member is at an acute angle relative to the main beam direction.

In another aspect, the second location is offset from the first location along the main beam direction.

In another aspect, the first location and the third location are at the same location along the main beam direction.

In one aspect, a ceiling system for use in a building space having a plurality of walls, the ceiling system includes a grid system that extends to at least two of the plurality of walls and separates the building space into an occupiable space below the grid system and a plenum space above the grid system, the grid system having a first main beam, a second main beam parallel to the first main beam, the first and second main beams extending longitudinally in a main beam direction, a first cross member that interests the first main beam at a first location and intersects the second main beam at a second location, and a second cross member that intersects the second main beam at a third location, the third location being offset from the second location along the main beam direction; and a plurality of ceiling tiles that are supported by the grid system and, with the grid system, create a barrier between the occupiable space and the plenum space. One of the plurality of ceiling tiles has a non-white color on its surface that faces the occupiable space, and no color on its surface that faces the plenum space.

Further areas of applicability of the present invention will become apparent from the detailed description provided hereinafter. It should be understood that the detailed description and specific examples, while indicating preferred embodiments of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

Figure 1:
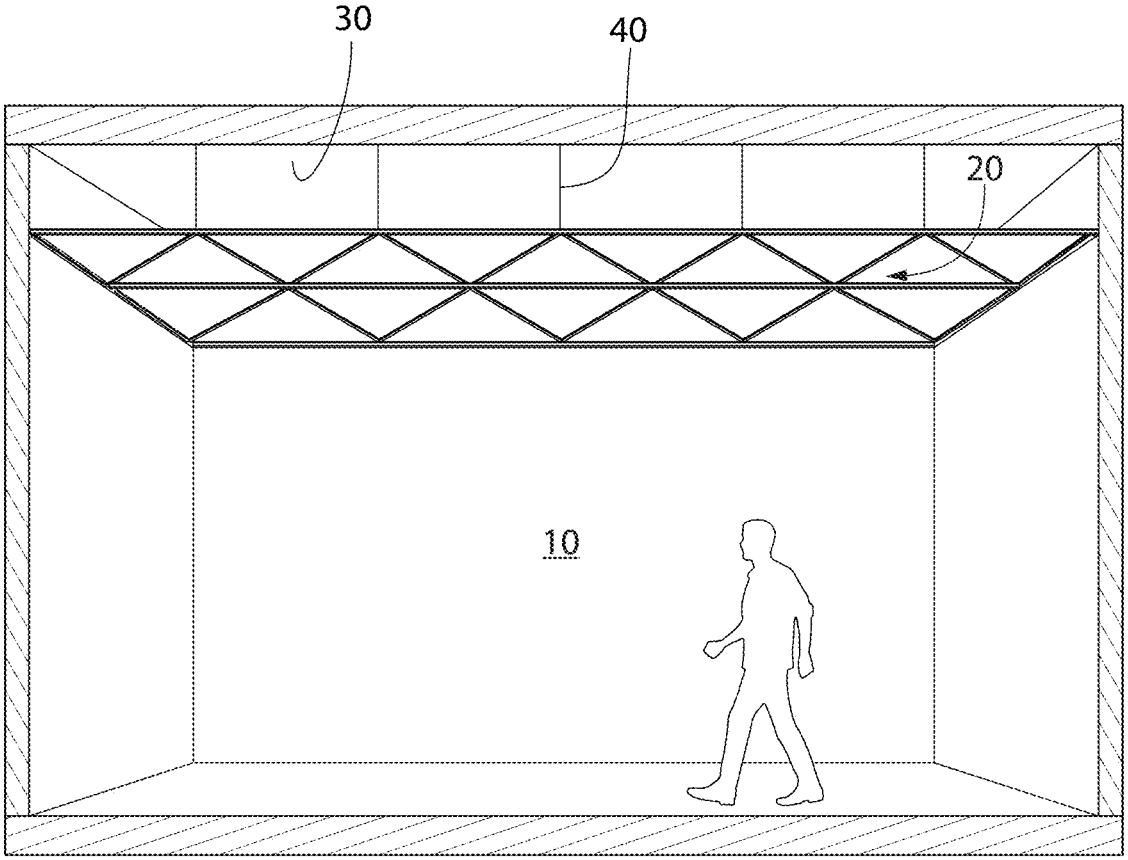
FIG. 1 is a perspective view of a ceiling system in accordance with exemplary embodiments of the invention in a building space.

All drawings are schematic and not necessarily to scale. Parts given a reference numerical designation in one figure may be considered to be the same parts where they appear in other figures without a numerical designation for brevity unless specifically labeled with a different part number and described herein.

DETAILED DESCRIPTION

The following description of the preferred embodiment(s) is merely exemplary in nature and is in no way intended to limit the invention, its application, or uses.

In the description of embodiments disclosed herein, any reference to direction or orientation is merely intended for convenience of description and is not intended in any way to limit the scope of the present invention. Relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation. Terms such as "attached," "connected," "coupled," "interconnected," and similar refer to a relationship wherein structures are secured or attached to one another either directly or indirectly through intervening structures, as well as both movable or rigid attachments or relationships, unless expressly described otherwise. The term "fixed" refers to two structures that cannot be separated without damaging one of the structures. The term "filled" refers to a state that includes completely filled or partially filled.

As used throughout, ranges are used as shorthand for describing each and every value that is within the range. Any value within the range can be selected as the terminus of the range. In addition, all references cited herein are hereby incorporated by reference in their entireties. In the event of a conflict in a definition in the present disclosure and that of a cited reference, the present disclosure controls.

FIG. 1 shows an example of a ceiling system 20 in accordance with the invention. In this example, ceiling system 20 is above an occupiable space 10 in, for example, an office building. A plenum space 30 is above ceiling system 20 and ceiling system 20 separates occupiable space 10 from plenum space 30. In some examples, duct work, electrical systems, and other equipment is contained in plenum space 30. In this example, the ceiling grid is in a configuration that creates open triangles that are shaped to receive triangular acoustical ceiling tiles.

Various type of tiles can be used with the grid system. In the case of acoustical tiles, the tiles may comprise fiberglass, mineral wool (such as rock wool, slag wool, or a combination thereof), synthetic polymers (such as melamine foam, polyurethane foam, or a combination thereof), mineral cotton, silicate cotton, gypsum, or combinations thereof. In some embodiments, the tile provides a sound attenuation function and preferred materials for providing the sound attenuation function include mineral wool. Such a tile can provide a CAC (Ceiling Attenuation Class) rating of at least 35, preferably at least 40. CAC is further described below. In some non-limiting embodiments, the tile may be selected from the School Zone™ and Calla™ panel lines produced by Armstrong—for example, School Zone 1810.

Acoustic ceiling panels exhibit certain acoustical performance properties. Specifically, the American Society for Testing and Materials (ASTM) has developed test method E1414 to standardize the measurement of airborne sound attenuation between room environments 3 sharing a common plenary space 2. The rating derived from this measurement standard is known as the Ceiling Attenuation Class (CAC). Ceiling materials and systems having higher CAC values have a greater ability to reduce sound transmission through a plenary space—i.e. sound attenuation function.

Another important characteristic for acoustic ceiling panel materials is the ability to reduce the amount of reflected sound in a room. One measurement of this ability is the Noise Reduction Coefficient (NRC) rating as described in ASTM test method C423. This rating is the average of sound absorption coefficients at four ⅓ octave bands (250, 500, 1000, and 2000 Hz), where, for example, a system having an NRC of 0.90 has about 90% of the absorbing ability of an ideal absorber. A higher NRC value indicates that the material provides better sound absorption and reduced sound reflection—sound absorption function.

Acoustic ceiling panels can have different constructions. In some cases, the body may be porous, thereby allowing airflow through the body between an upper surface and a lower surface 121. The body may be comprised of a binder and fibers. In some embodiments, the body may further comprise a filler and/or additive.

Non-limiting examples of binder may include a starch-based polymer, polyvinyl alcohol (PVOH), a latex, polysaccharide polymers, cellulosic polymers, protein solution polymers, an acrylic polymer, polymaleic anhydride, epoxy resins, or a combination of two or more thereof.

The binder may be present in an amount ranging from about 1 wt. % to about 25 wt. % based on the total dry weight of the body—including all values and sub-ranges there-between. The phrase "dry-weight" refers to the weight of a referenced component without the weight of any carrier. Thus, when calculating the weight percentages of components in the dry-state, the calculation should be based solely on the solid components (e.g., binder, filler, hydrophobic component, fibers, etc.) and should exclude any amount of residual carrier (e.g., water, VOC solvent) that may still be present from a wet-state, which will be discussed further herein. According to the present invention, the phrase "dry-state" may also be used to indicate a component that is substantially free of a carrier, as compared to the term "wet-state," which refers to that component still containing various amounts of carrier.

Non-limiting examples of filler may include powders of calcium carbonate, including limestone, titanium dioxide, sand, barium sulfate, clay, mica, dolomite, silica, talc, perlite, polymers, gypsum, wollastonite, expanded-perlite, calcite, aluminum trihydrate, pigments, zinc oxide, or zinc sulfate. The filler may be present in an amount ranging from about 25 wt. % to about 99 wt. % based on the total dry weight of the body—including all values and sub-ranges there-between.

Non-limiting examples of additives include defoamers, wetting agents, biocides, dispersing agents, flame retardants, and the like. The additive may be present in an amount ranging from about 0.01 wt. % to about 30 wt. % based on the total dry weight of the body—including all values and sub-ranges there-between.

The fibers may be organic fibers, inorganic fibers, or a blend thereof. Non-limiting examples of inorganic fibers mineral wool (also referred to as slag wool), rock wool, stone wool, and glass fibers. Non-limiting examples of organic fiber include fiberglass, cellulosic fibers (e.g. paper fiber—such as newspaper, hemp fiber, jute fiber, flax fiber, wood fiber, or other natural fibers), polymer fibers (including polyester, polyethylene, aramid—i.e., aromatic polyamide, and/or polypropylene), protein fibers (e.g., sheep wool), and combinations thereof. Depending on the specific type of material, the fibers 130 may either be hydrophilic (e.g., cellulosic fibers) or hydrophobic (e.g. fiberglass, mineral wool, rock wool, stone wool). The fibers may be present in an amount ranging from about 5 wt. % to about 99 wt. % based on the total dry weight of the body—including all values and sub-ranges there-between.

A face coating may comprise a binder, a pigment, and optionally a dispersant.

Non-limiting examples of a binder include polymers selected from polyvinyl alcohol (PVOH), latex, an acrylic polymer, polymaleic anhydride, or a combination of two or more thereof. Non-limiting examples of a latex binder may include a homopolymer or copolymer formed from the following monomers: vinyl acetate (i.e., polyvinyl acetate), vinyl propinoate, vinyl butyrate, ethylene, vinyl chloride, vinylidene chloride, vinyl fluoride, vinylidene fluoride, ethyl acrylate, methyl acrylate, propyl acrylate, butyl acrylate, ethyl methacrylate, methyl methacrylate, butyl methacrylate, hydroxyethyl methacrylate, hydroxyethyl acrylate, styrene, butadiene, urethane, epoxy, melamine, and an ester. Preferably the binder is selected from the group consisting of aqueous lattices of polyvinyl acetate, polyvinyl acrylic, polyurethane, polyurethane acrylic, polystyrene acrylic, epoxy, polyethylene vinyl chloride, polyvinylidene chloride, and polyvinyl chloride.

The face coating may be a color surface coating. The term "color surface coating" refers to a surface coating comprising a color pigment and the resulting surface coating exhibits a color on the visible color spectrum—i.e., violet, blue, green, yellow, orange, or red. The color surface coating may also have a color of white, black, or grey. The color surface coating may further comprise combinations of two or more colors—such a primary color (i.e., red, yellow, blue) as well as an achromatic color (i.e., white, grey).

A non-limiting example of a color surface coating may be pink and produced from a combination of red and white pigments. Another non-limiting example of a color surface coating may be green and produced from a combination of blue and yellow pigments. Another non-limiting example of a color surface coating may be brown and produced from a combination of red, yellow, and black pigments.

The pigment may be an inorganic pigment. Non-limiting examples of inorganic pigment include particles of carbon black, graphite, graphene, copper oxide, iron oxide, zinc oxide, calcium carbonate, manganese oxide, titanium dioxide and combinations thereof. The inorganic pigments may include individual particles having colors selected from, but not limited to, red, blue, yellow, black, green, brown, violet, white, grey and combinations thereof. The particles that make up the first pigment may have a particle size ranging from about 15 nm to about 1000 μm—including all sizes and sub-ranges there-between.

Ceiling tiles other than the acoustic tiles described above can also be used in embodiments of the invention. For example, tiles made from metal, wood, plastic, composites, or other materials can be used.

Some existing ceiling systems use a square grid system and all of the tiles are the same size and shape. This configuration limits the changes possible to the visual appearance of the system.

Figure 2:
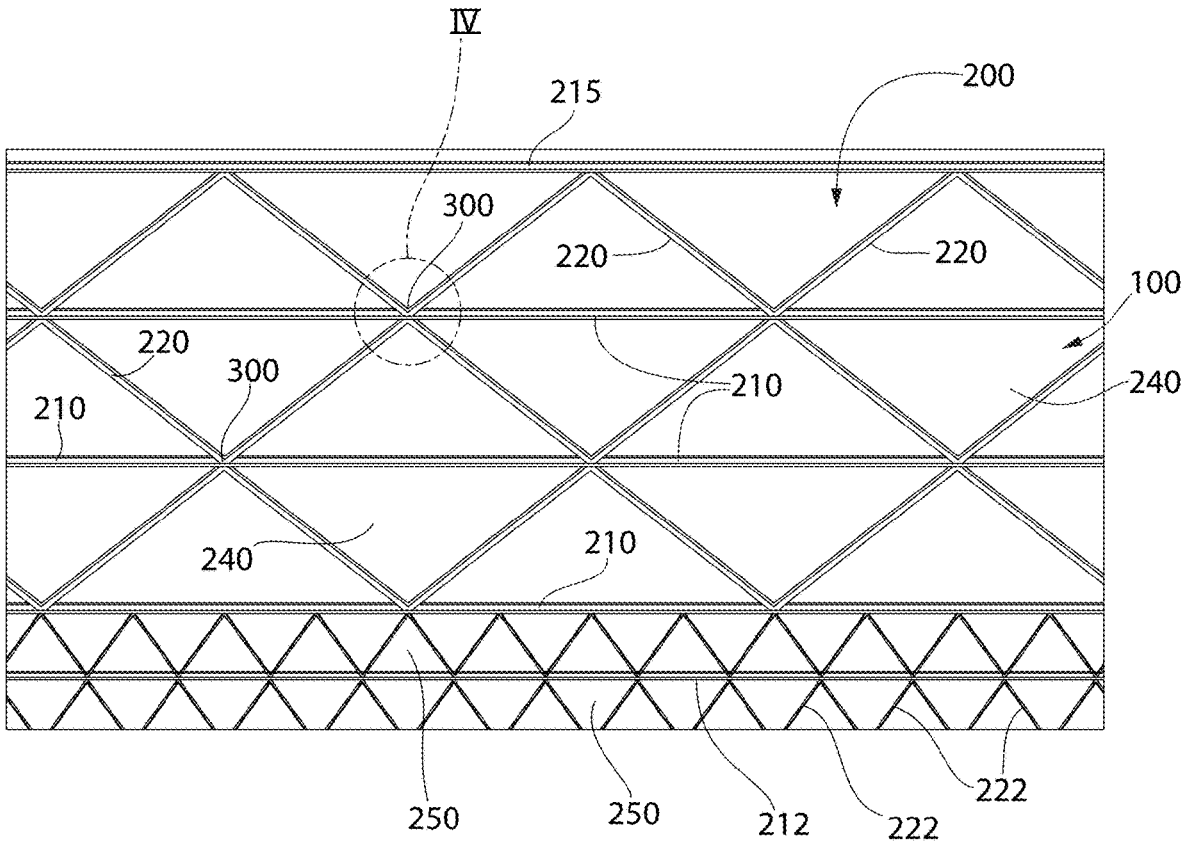
FIG. 2 is a lower perspective view of a ceiling grid system in accordance with exemplary embodiments of the invention.

FIG. 2 shows an example of an embodiment of the invention that provides much more flexibility as to the different visual appearances that can be achieved. In this example, this section of a ceiling grid system 100 is configured in two different patterns. In the upper section, a plurality of main beams 210 (running left to right in the figure) are, in this example, parallel to each other. A plurality of cross members 220 are shown connecting adjacent main beams 210. In this example, cross members 220 intersect main beams 210 at location 300 and form an acute angle of approximately 45 degrees. This configuration creates openings 240 for receiving ceiling tiles. Other examples include cross members intersecting main beams at other angles.

In the lower section of FIG. 2 a main beam 212 runs parallel to main beams 210 but at a smaller spacing from the adjacent main beam 210. A plurality of cross members 222 are shown connecting main beam 212 and adjacent main beam 210. In this example, cross members 222 intersect main beams 210, 212 at an acute angle of approximately 60 degrees. This configuration creates openings 250 for receiving ceiling tiles. Other examples include cross members intersecting main beams at other angles. Main beams 212 and cross members 222 can be the same cross-sectional size and/or shape as main beams 210 and cross members 220 or they can be different sizes and/or shapes.

Grid system 100 includes a perimeter member 215 along the perimeter of grid 100. Because FIG. 2 shows only a portion of grid system 100, perimeter member 215 is only shown along the top edge of the figure. However, perimeter member 215 extends, in this example, around the entire perimeter of grid system 100. In particular embodiments, perimeter member 215 is attached to every wall, column, or other surface to which grid system 100 contacts.

Figure 3:
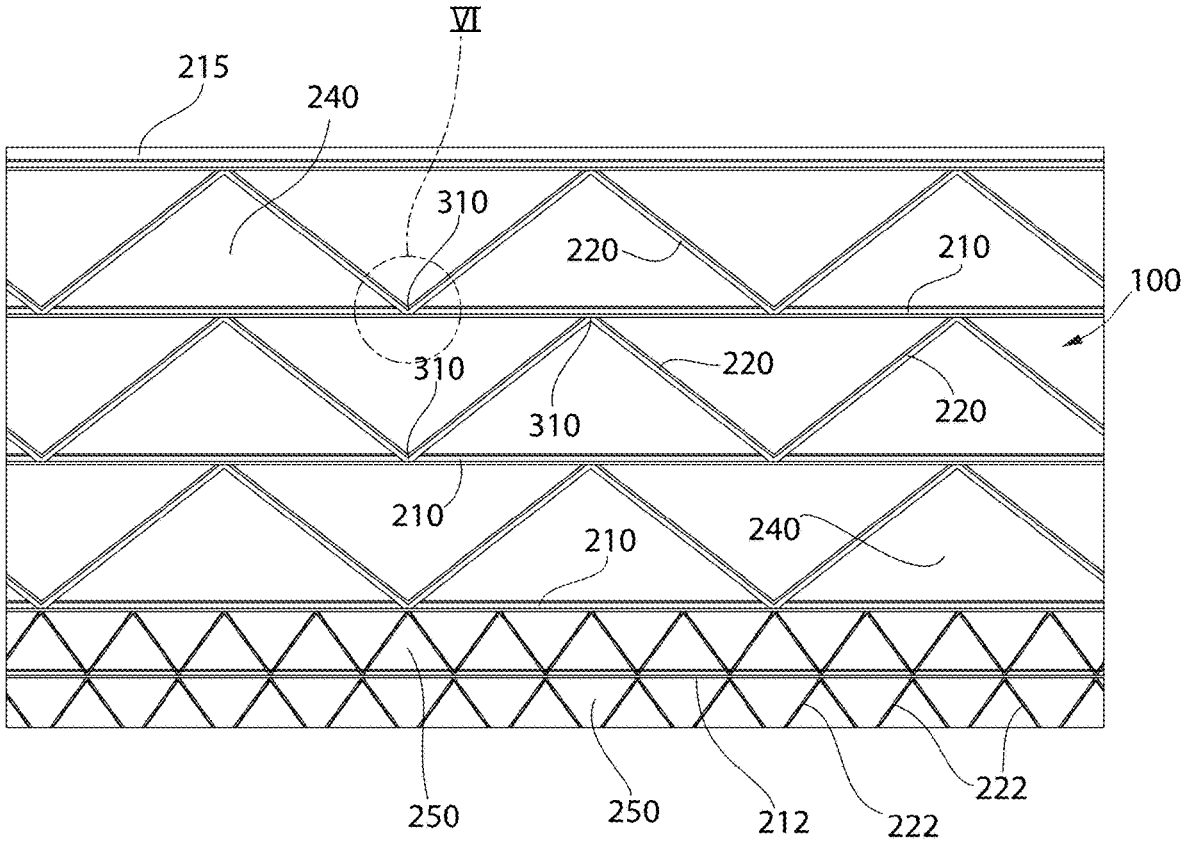
FIG. 3 is a lower perspective view of a ceiling grid system in accordance with exemplary embodiments of the invention.

FIG. 3 shows another example of grid system 100 in accordance with embodiments of the invention. The example shown in FIG. 3 is similar to the example shown in FIG. 2, except that in the upper section of the grid pattern cross members 220 on one side of main beams 210 do not align with cross members 220 on the other side of the same main beam 210. At location 310, two cross members 220 intersect with one main beam 210 at, in this example, an acute angle of approximately 45 degrees on a first side of main beam 210. Other examples include cross members intersecting main beams at other angles. Unlike location 300 in FIG. 2, at location 310 there are no cross members intersecting the second side of main beam 210.

Like in FIG. 2, grid system 100 includes a perimeter member 215 along the perimeter of grid 100. Because FIG. 3 shows only a portion of grid system 100, perimeter member 215 is only shown along the top edge of the figure. However, perimeter member 215 extends, in this example, around the entire perimeter of grid system 100. In particular embodiments, perimeter member 215 is attached to every wall, column, or other surface to which grid system 100 extends.

FIGS. 2 and 3 show only two configurations of the many possible configurations of grid system 100 when the teachings of the invention are applied. Several additional examples of possible configurations are shown in later Figures and described below. The examples shown in the Figures are not limiting and are recognized as only some of the possible configurations.

Figure 4:
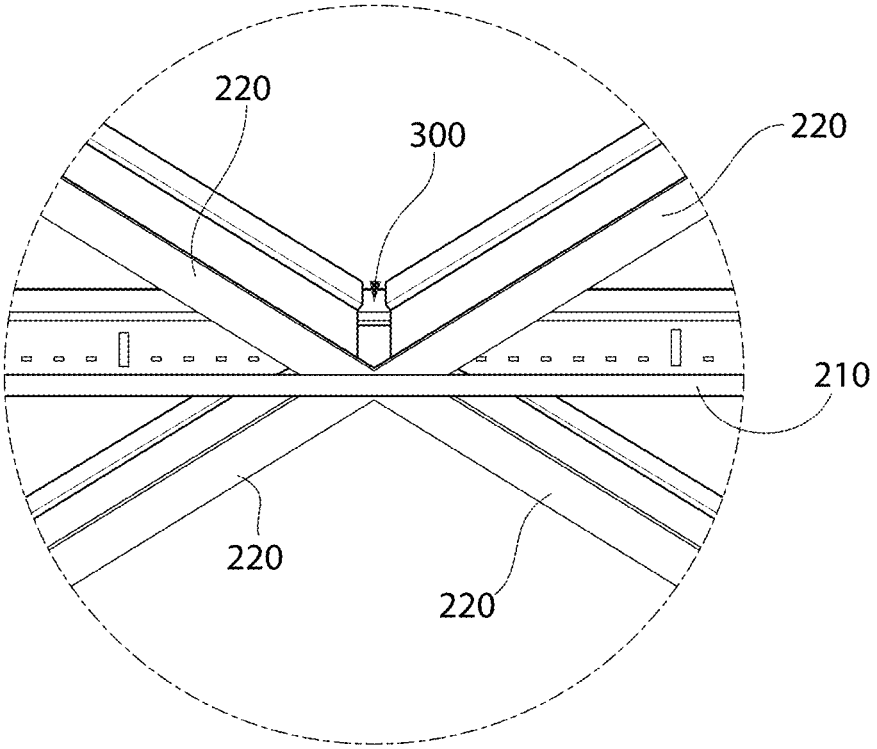
FIG. 4 is a detail view of a portion of the system shown in FIG. 3.

FIG. 4 is a lower perspective view showing location 300 (from FIG. 2) in more detail. In this example, four cross members 220 intersect and are attached to one main beam 210. Cross members 220 can be attached to main beam 210 by way of a screw or other fastener. In other embodiments, each cross member 220 can be attached to main beam 210 by way of a separate bracket for each cross member 220, one bracket for the two cross members 220 on one side of main beam 210, or one bracket for all four cross members 220 that intersect main beam 210 at location 300. Cross members 220 can be attached to main beam 210 or the bracket by a screw, rivet, or other fastener or can be welded or otherwise permanently attached. The example shown in FIG. 4 is not limiting and it is noted that other angles and numbers of cross members 220 can also be used. Also, some or each cross member 220 can intersect main beam 210 at a different angle than the other cross members 220 that intersect at the same location.

Figure 5:
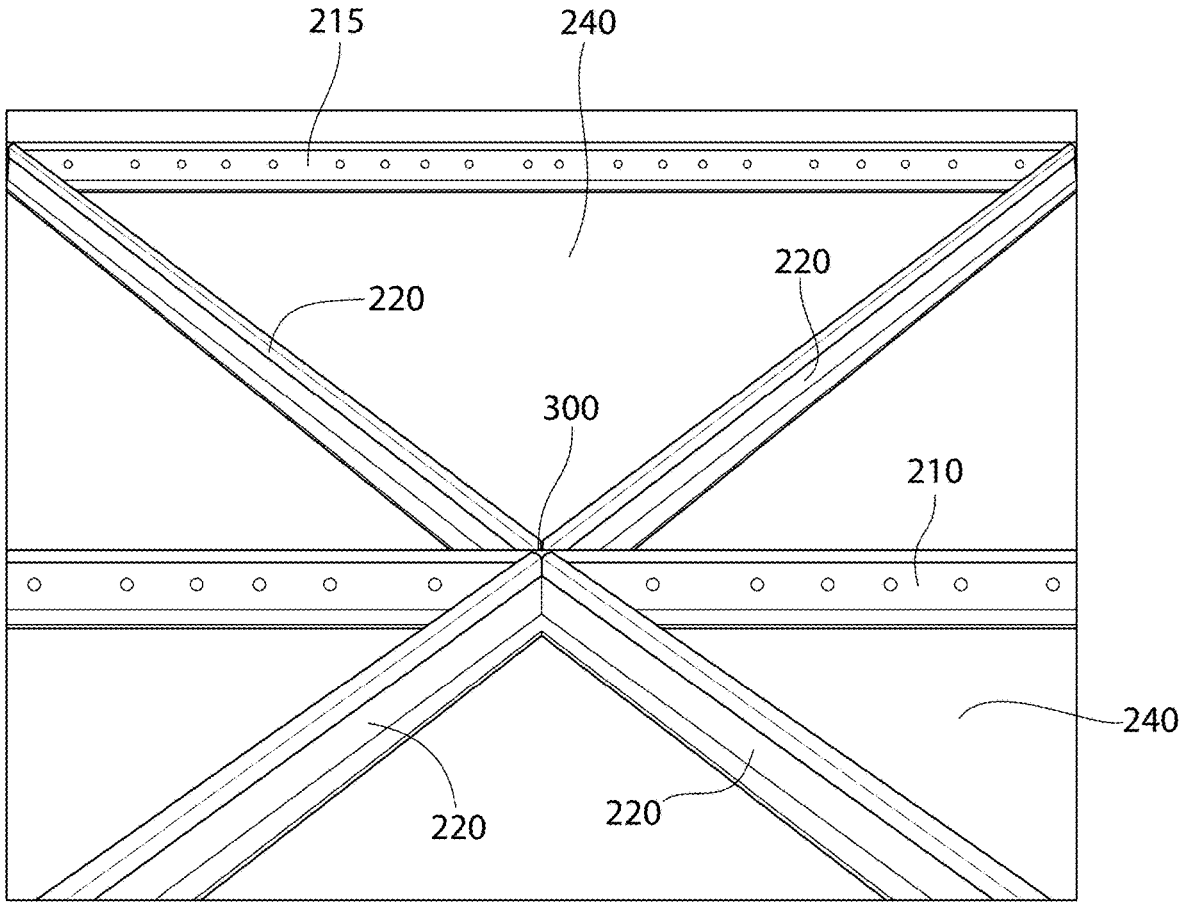
FIG. 5 is a detail view of a portion of a ceiling grid system in accordance with exemplary embodiments of the invention.

FIG. 5 is an upper perspective view showing location 300 (FIG. 2) in more detail. In this example, each cross member 220 attaches to main beam 210 by way of a small bracket (not shown) located in the acute angle formed by cross member 220 and main beam 210. These brackets can be pre-formed at a particular angle to facilitate the installation of cross members 220 at the desired angle. In other embodiments, cross members 220 are attached directly to main beam 210 by way of a bracket preformed into cross member 220 at the desired angle.

Figure 6:
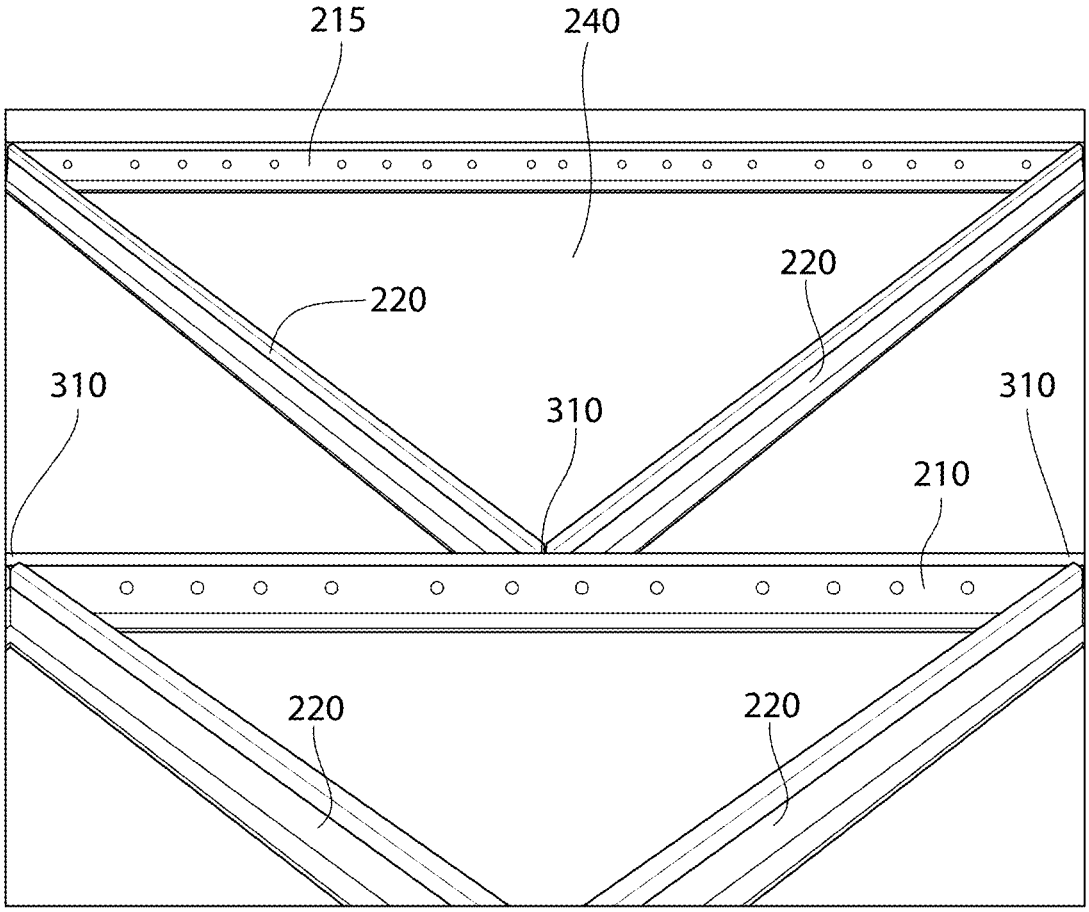
FIG. 6 is a detail view of a portion of a ceiling grid system in accordance with exemplary embodiments of the invention.

FIG. 6 is an upper perspective view showing location 310 (FIG. 3) in more detail. In this example, each cross member 220 attaches to main beam 210 by way of a small bracket (not shown) located in the acute angle formed by cross member 220 and main beam 210. These brackets can be pre-formed at a particular angle to facilitate the installation of cross members 220 at the desired angle. In other embodiments, cross members 220 are attached directly to main beam 210 by way of a bracket preformed into cross member 220 at the desired angle.

Figure 7:
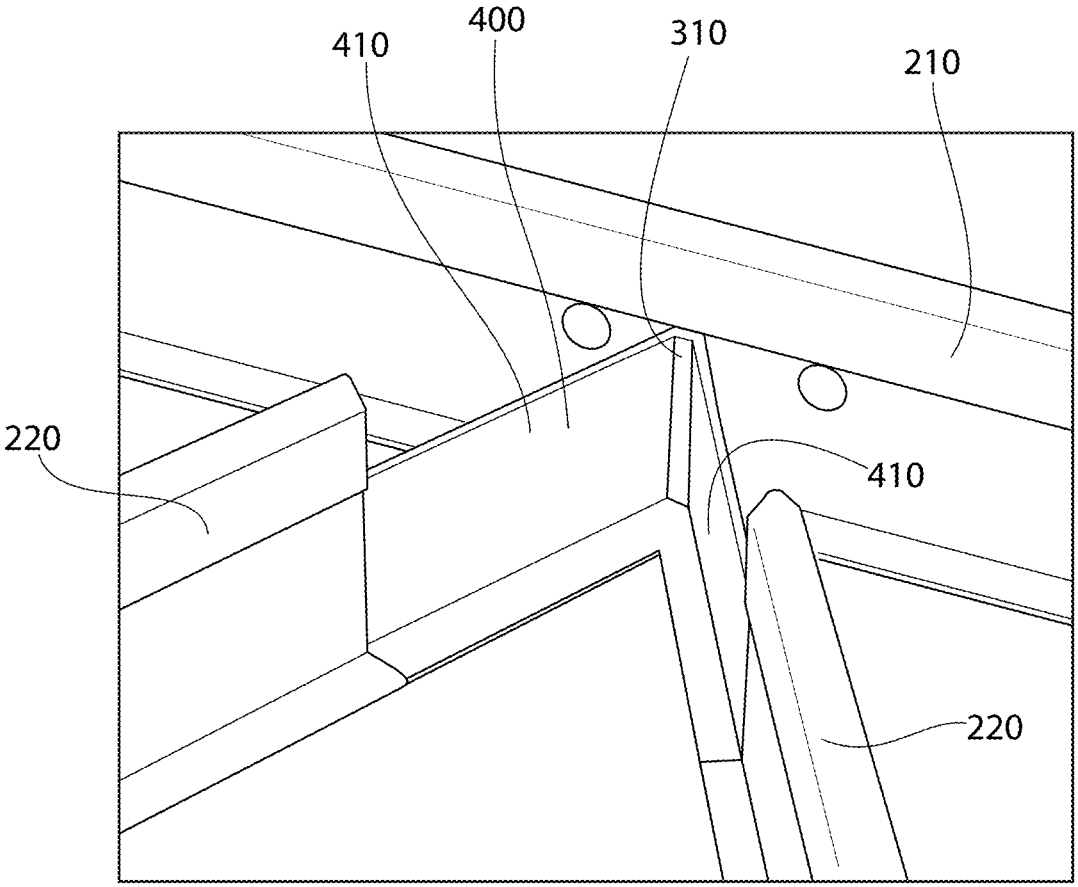
FIG. 7 is a detail view of a portion of a ceiling grid system in accordance with exemplary embodiments of the invention.

FIG. 7 shows an example of a bracket 400 used to attached cross members 220 to main beam 210 at location 310 (FIG. 3). In this example, bracket 400 has two tabs 410. Each tab 410 is attached to a cross member 220. Bracket 400 is also attached to main beam 210 at, in this example, the point of the "V" of bracket 400. These attachments can be by way of screws, rivets, clips, welds, or other forms. Bracket 400 can have flanges on its bottom side that continue the profile of the bottom side of cross members 200 (similar to what is shown in FIG. 4).

Figure 8:
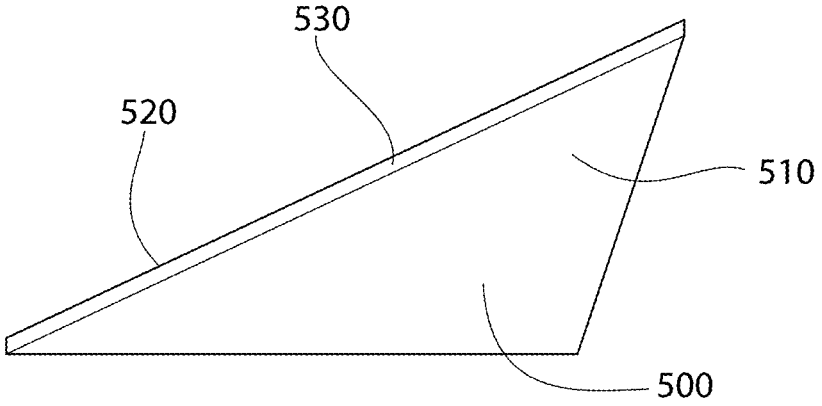
FIG. 8 is a perspective view of a ceiling panel in accordance with exemplary embodiments of the invention.

FIG. 8 shows an example of a ceiling tile 500 in accordance with embodiments of the invention. In this example, ceiling tile 500 has a front face 510 and a back face 520 that is parallel to front face 510. Ceiling tile 500 has an edge 530 that extends around the perimeter of ceiling tile 500. Edge 530 is perpendicular to both front face 510 and back face 520. Ceiling tile 500 is installed in grid system 100 such that a small perimeter portion of front face 510 rests on a main bean 210 and/or one or more cross members 220. After installation, front face 510 is visible from the occupiable space except for the small perimeter portion of front face 510 that is hidden by the main beam 210 and/or the one or more cross members 220 on which ceiling tile 500 rests. In some situations, ceiling tile 500 may rest on one or more perimeter members 215. Ceiling tile 500 can be any shape including, for example, a triangle, square, rectangle, pentagon, hexagon, or any other polygon. For particular installations, other non-regular shapes may be required to, for example, fit around columns or other abnormalities in the ceiling plan.

Figure 9:
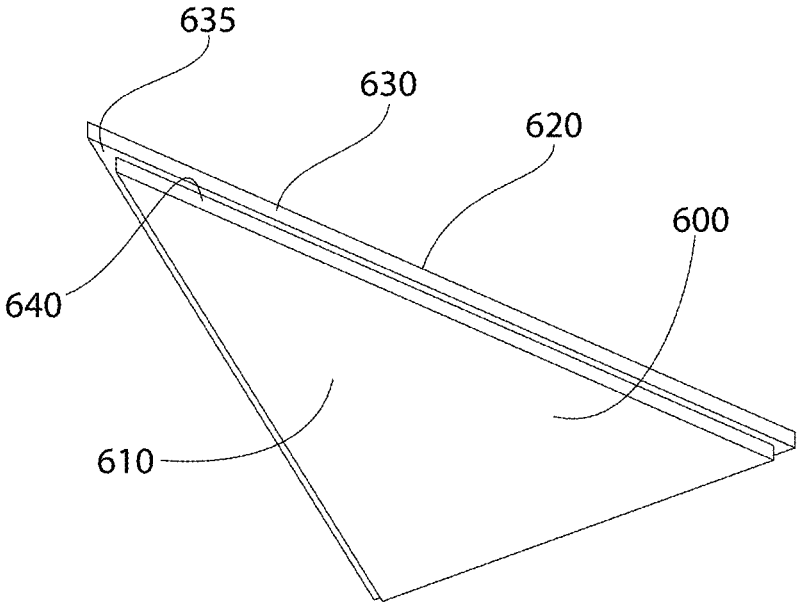
FIG. 9 is a perspective view of a ceiling panel in accordance with exemplary embodiments of the invention.

FIG. 9 shows an example of a tegular ceiling tile 600 in accordance with embodiments of the invention. In this example, tegular ceiling tile 600 has a front face 610 and a back face 620 that is parallel to front face 610. Tegular ceiling tile 600 has a back edge 630 that extends around the perimeter of tegular ceiling tile 600 adjacent to back face 620. Back edge 630 is perpendicular to back face 620. Tegular ceiling tile 600 has a front edge 640 that extends around the perimeter of tegular ceiling tile 600 adjacent to front face 610. Front edge 640 is perpendicular to front face 610. A ledge 635 extends between front edge 640 and back edge 630 and is, in this example, parallel to front face 610 and back face 620. Tegular ceiling tile 600 is installed in grid system 100 such all or part of ledge 635 rests on a main bean 210 and/or one or more cross members 220. After installation, front face 610 is visible from the occupiable space but the part of ledge 635 that is hidden by the main beam 210 and/or the one or more cross members 220 on which tegular ceiling tile 600 rests is not. In some situations, tegular ceiling tile 600 may rest on one or more perimeter members 215. Tegular ceiling tile 600 can be any shape including, for example, a triangle, square, rectangle, pentagon, hexagon, or any other polygon. For particular installations, other non-regular shapes may be required to, for example, fit around columns or other abnormalities in the ceiling plan.

Figure 10:
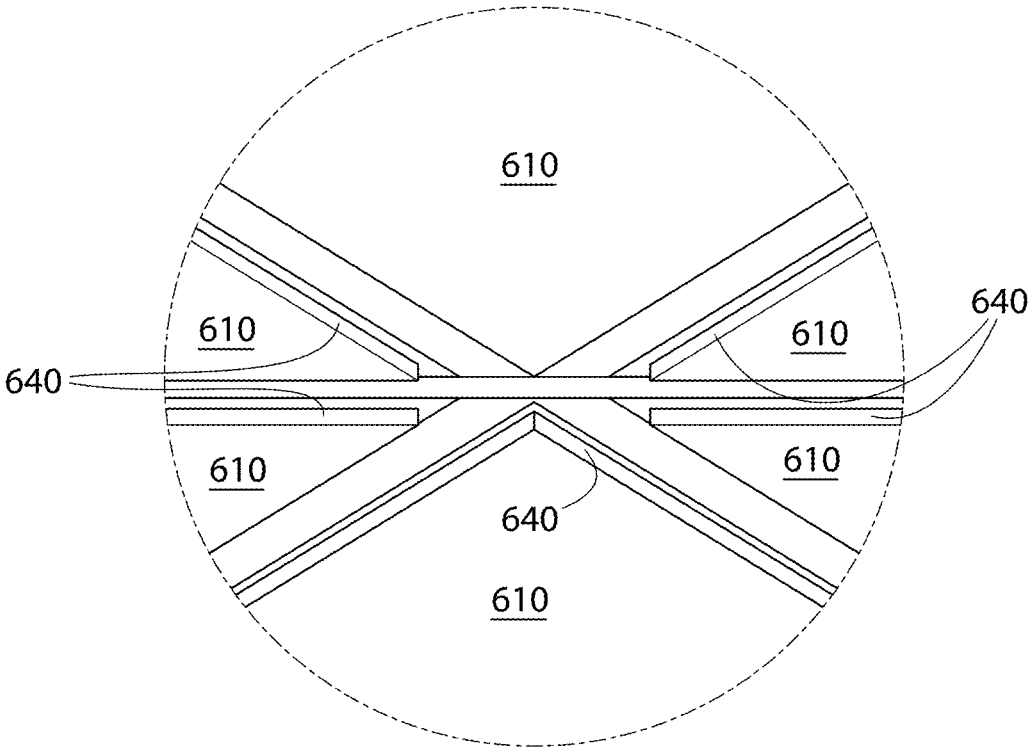
FIG. 10 is a detail view of a portion of the system in accordance with exemplary embodiments of the invention.

FIG. 10 is a lower perspective view showing location 300 (from FIG. 4) but including tegular tiles 600. In this example, four cross members 220 intersect and are attached to one main beam 210. In other embodiments, each cross member 220 can be attached to main beam 210 by way of a separate bracket for each cross member 220, one bracket for the two cross members 220 on one side of main beam 210, or one bracket for all four cross members 220 that intersect main beam 210 at location 300. Cross members 220 can be attached to main beam 210 or the bracket by a screw, rivet, or other fastener or can be welded or otherwise permanently attached. The example shown in FIG. 10 is not limiting and it is noted that other angles and numbers of cross members 220 can also be used. Also, some or each cross member 220 can intersect main beam 210 at a different angle than the other cross members 220 that intersect at the same location. Further, tegular tiles with a greater or lesser depth to front edge 640 can be used. Also, a mixture of tegular tiles 600 and tiles 500 can be used.

Figure 11:
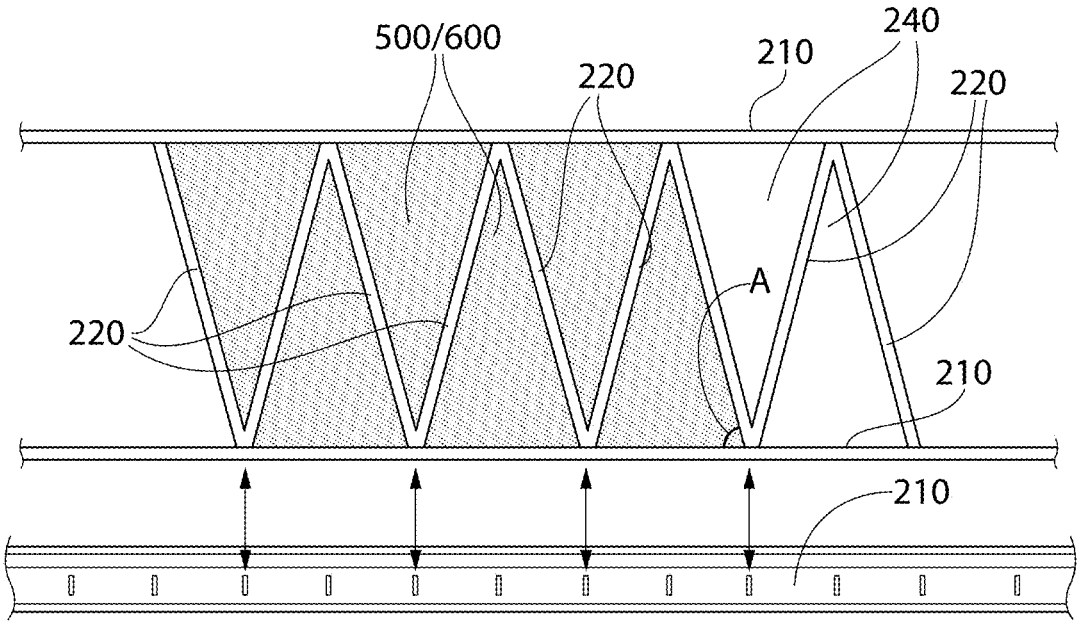
FIG. 11 is a plan view of a ceiling system in accordance with exemplary embodiments of the invention.

FIG. 11 shows an example of a plurality of triangular ceiling tiles 500/600 installed in an alternating pattern between two main beams 210. Cross members 220 are installed between the two main beams 210 to provide support for ceiling tiles 500/600 at their edges that are not supported by main beams 210 in openings 240. The main beam 210 shown in this Figure is a standard main beam with standard spacing of vertical slots used to attach cross members 220 to main beam 210. This standard spacing has been established to coincide with a spacing of cross members that receive 2' square ceiling tiles. In order for particular grid systems in accordance with the invention to be able to utilize these standard main beams 210, certain angles for triangular ceiling tiles are used. For example, in a grid having main beams 210 spaced on 48 inch centers, instead of using a triangular ceiling tile having an angle A equal to 75 degrees, an angle A of 75.964 degrees is used. This causes the base of the triangular ceiling tile to be 24 inches, which will cause the ends of cross members 220 to fall at one of the slots in main beams 210. Similarly, instead of a 60 degree angle A, a 63.435 degree angle A is used; and instead of a 30 degree angle A, a 26.565 degree angle A is used. In other embodiments, any angle can be used but a custom designed main beam may be required to provide proper attachment points for cross members 220. It is noted that in this description the term "nominal" in relation to an angle is meant to include both the exact angle and angles approximately equal to the exact angle as, for example, described above.

Figure 12:
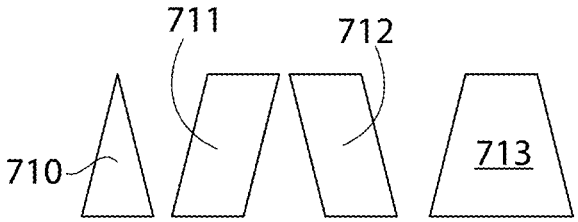
FIG. 12 shows a plurality of ceiling panels in accordance with exemplary embodiments of the invention.

FIG. 12 shows a plurality of shapes 710, 711, 712, 713 using a nominal 75 degree angle with main beam 210. Other shapes having a nominal 75 degree angle can also be used such as, for example, a parallelogram shaped ceiling tile 711 or 712 having a longer or shorter base, or a trapezoid shaped ceiling tile 713 having a longer or shorter base.

Figure 13:
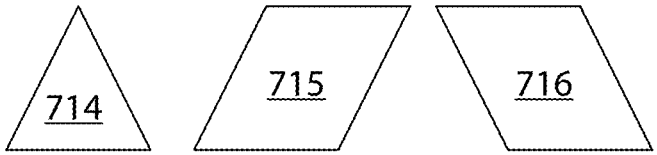
FIG. 13 shows a plurality of ceiling panels in accordance with exemplary embodiments of the invention.

FIG. 13 shows a plurality of shapes 714, 715, 716 using a nominal 60 degree angle with main beam 210. Other shapes having a nominal 60 degree angle can also be used such as, for example, a parallelogram shaped ceiling tile 715 or 716 having a longer or shorter base, or a trapezoid shaped ceiling tile (not shown).

Figure 14:
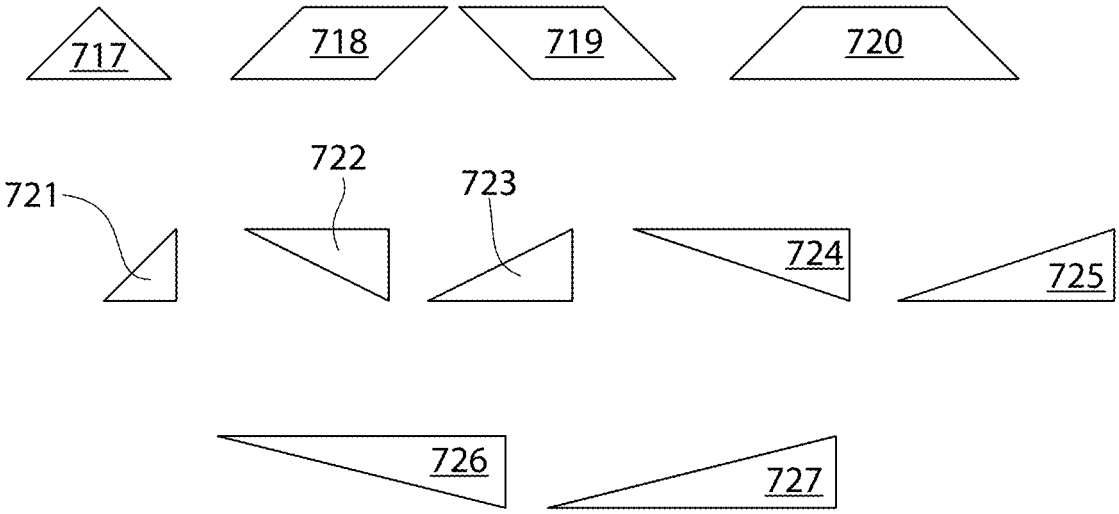
FIG. 14 shows a plurality of ceiling panels in accordance with exemplary embodiments of the invention.

FIG. 14 shows a plurality of shapes 717, 718, 719, 720, 721 using a nominal 45 degree angle with main beam 210. Other shapes having a nominal 45 degree angle can also be used such as, for example, a parallelogram shaped ceiling tile 718 or 719 having a longer or shorter base, or a trapezoid shaped ceiling tile 720 having a longer or shorter base. FIG. 14 also shows a plurality of shapes 722, 723, 724, 725, 726, 727 using other nominal angles with main beam 210. Other shapes having other nominal angles can also be used such as, for example, a parallelogram shaped ceiling tile, or a trapezoid shaped ceiling tile. Many shapes can be used provided that the ceiling tile is properly supported by main beams 210, cross members 220, and perimeter members 215. Different ceiling tile materials require differing amounts of support due to the strength and rigidity of the material and the shape of the ceiling tile.

Figure 15:
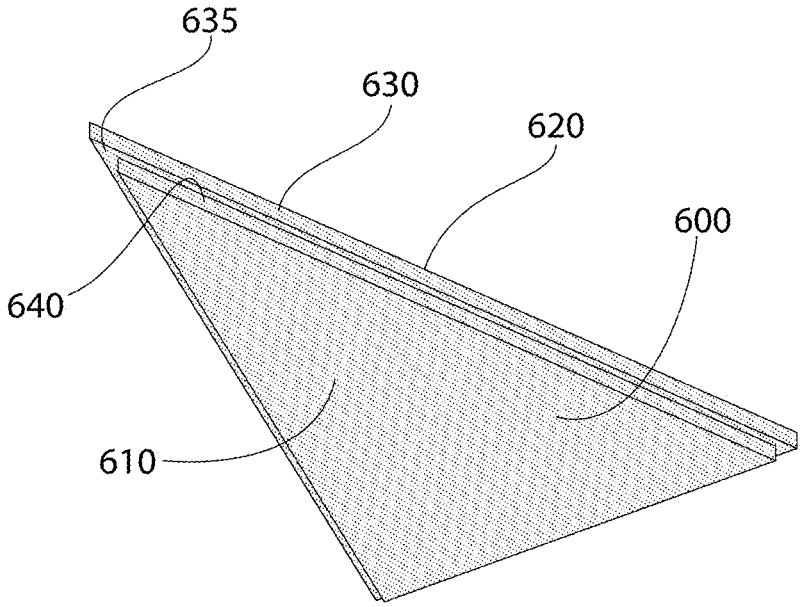
FIG. 15 is a perspective view of a ceiling panel in accordance with exemplary embodiments of the invention.

FIG. 15 shows an example of tegular ceiling tile 600 in accordance with embodiments of the invention. In this example, tegular ceiling tile 600 is similar to the example shown in FIG. 9 except that this example is partially colored. Front face 610, back edge 630, front edge 640, and ledge 635 are, in this example, colored differently than back face 620. For example, front face 610, back edge 630, front edge 640, and ledge 635 can be painted, dyed, or stained red while back face 620 is a natural color of the tile material or is painted, dyed, or stained white. In other examples, back edge 630, for example, is colored the same color as back face 620. Other examples color some other combination of surfaces of the tile. Tegular ceiling tile 600 is installed in grid system 100 such all or part of ledge 635 rests on a main bean 210/212 and/or one or more cross members 220/222. After installation, front face 610 is visible from the occupiable space but the part of ledge 635 that is hidden by the main beam 210 and/or the one or more cross members 220 on which tegular ceiling tile 600 rests is not. In some situations, tegular ceiling tile 600 may rest on one or more perimeter members 215. Tegular ceiling tile 600 can be any shape including, for example, a triangle, square, rectangle, pentagon, hexagon, or any other polygon. For particular installations, other non-regular shapes may be required to, for example, fit around columns or other abnormalities in the ceiling plan.

Figure 16:
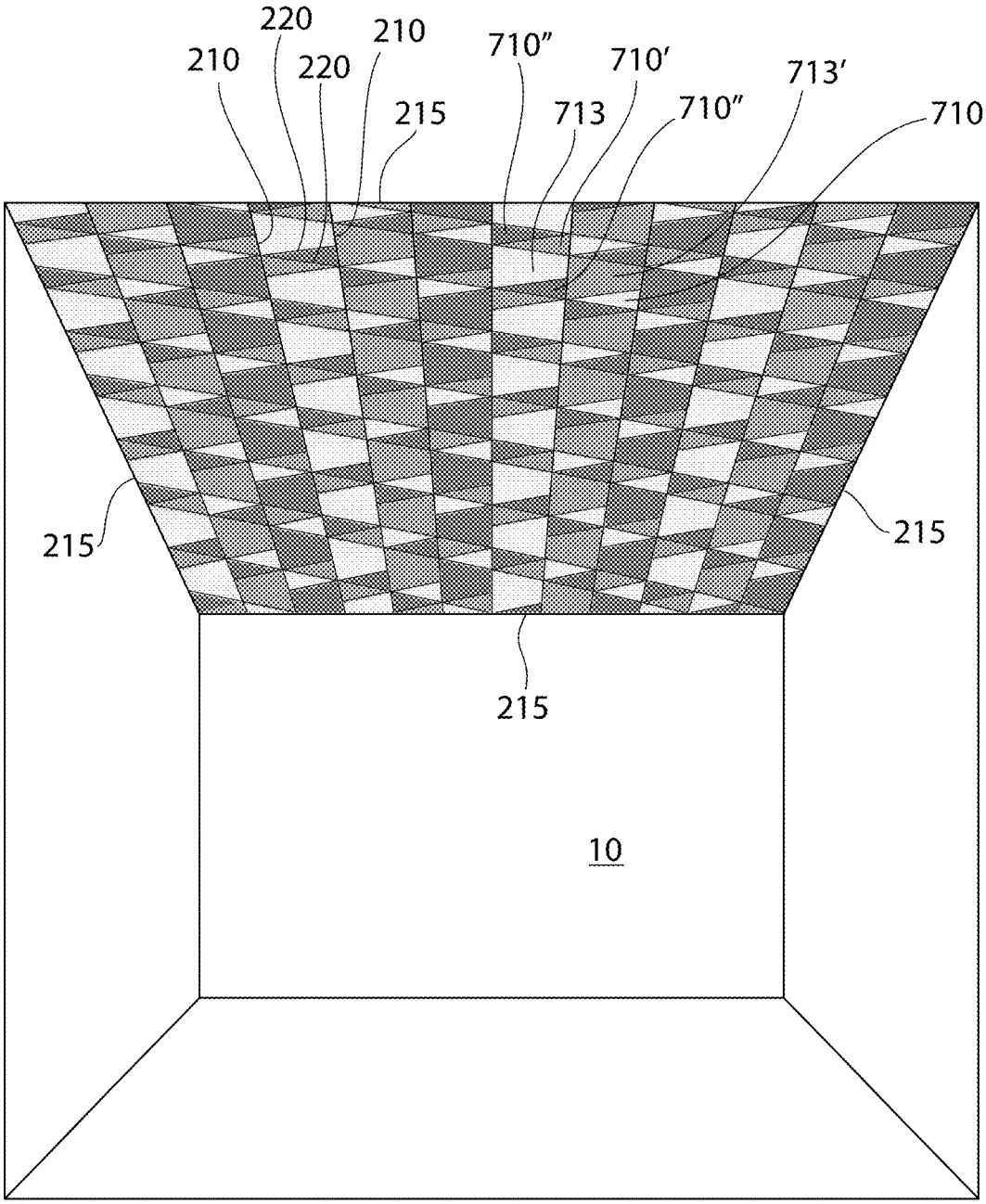
FIG. 16 is a perspective view of ceiling system in accordance with exemplary embodiments of the invention.
Figure 17:
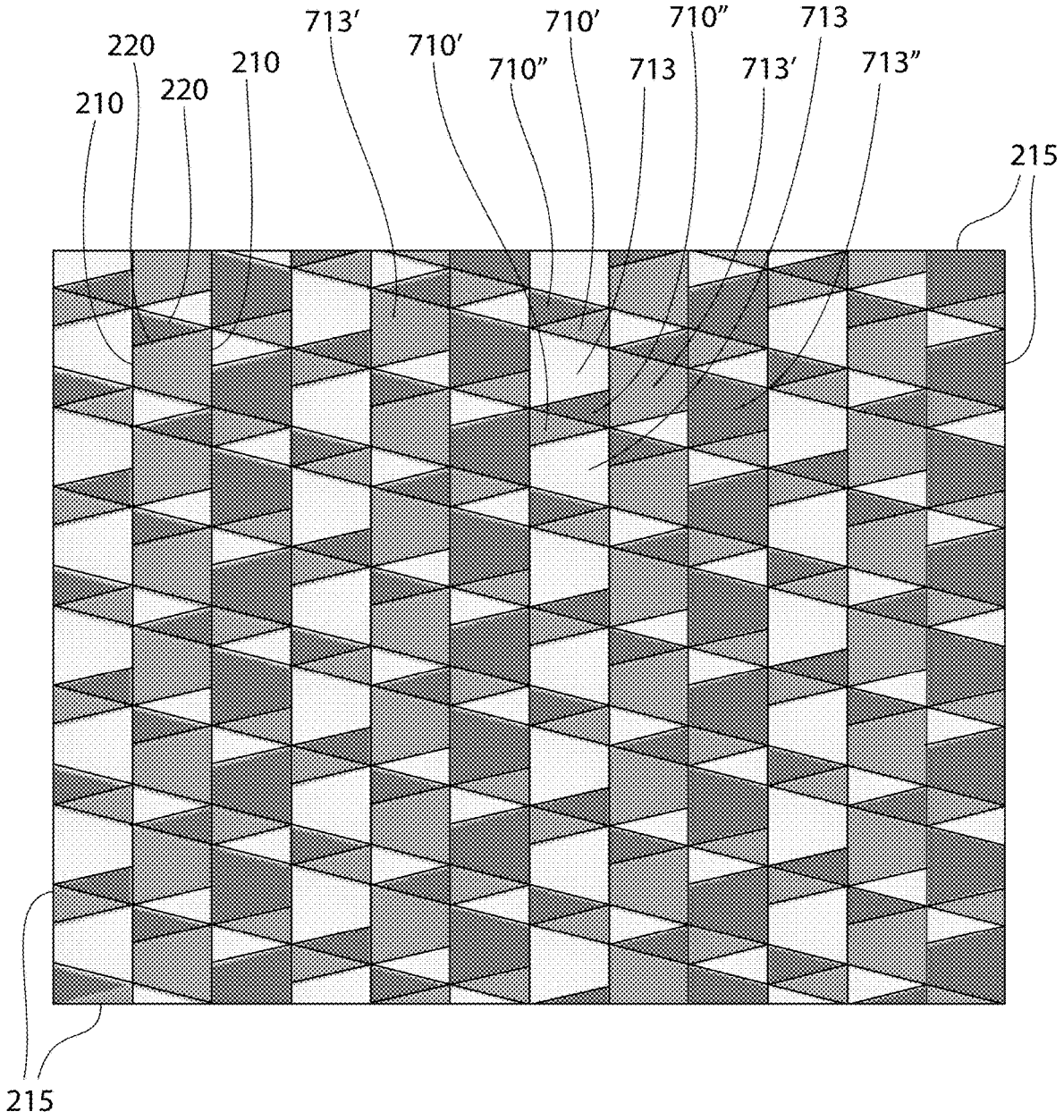
FIG. 17 is a plan view of the ceiling system shown in FIG. 16.

FIGS. 16 and 17 show an example of a ceiling system in accordance with embodiments of the invention. In this example, the entire ceiling is formed by a grid that includes a plurality of parallel main beams 210 and a plurality of cross members 220 bridging the space between main beams 210. The ceiling has perimeter members 215 at each wall to form the perimeter of the ceiling. In this example, two of the perimeter members 215 are parallel to main beams 210, and two of the perimeter members 215 are perpendicular to, and run across the ends of, main beams 210. The pattern shown in FIGS. 14 and 15 includes only two different shape ceiling tiles and three colors/shades of each shape. Triangle shaped ceiling tiles 710 are a light color/shade, triangle shaped ceiling tiles 710' are a medium color/shade, and triangle shaped ceiling tiles 710" are a dark color/shade. Similarly, trapezoid shaped ceiling tiles 713 are a light color/shade, trapezoid shaped ceiling tiles 713' are a medium color/shade, and trapezoid shaped ceiling tiles 713" are a dark color/shade. In this example, cross members 220 intersect main beams 210 at a nominal 75 degree angle and are spaced are an alternating distance from each other. In this case, most of the cross members 220 run parallel to each other, span between two main beams 210, and are alternately spaced one unit apart and two units apart. Other cross members 220 span between two main beams 210 but at a different angle to support an edge of a trapezoid shaped ceiling tile. This is only one example of how using non-uniform spacing of cross members 220 can allow different patterns. This example also shows conditions where two cross members 220 intersect a main beam 210 from both sides at a particular location, and conditions where only one cross member 220 intersects a main beam 210 at a particular location. At other locations, three cross members 220 intersect one main beam 210 at a particular location. Other examples of the grid pattern shown can be used with tiles having more or fewer different colors/shades and or different textures. The different colors/shades can be achieved using paints, dyes, stains, films, fabrics, or other coloring techniques or colored materials.

Figure 18:
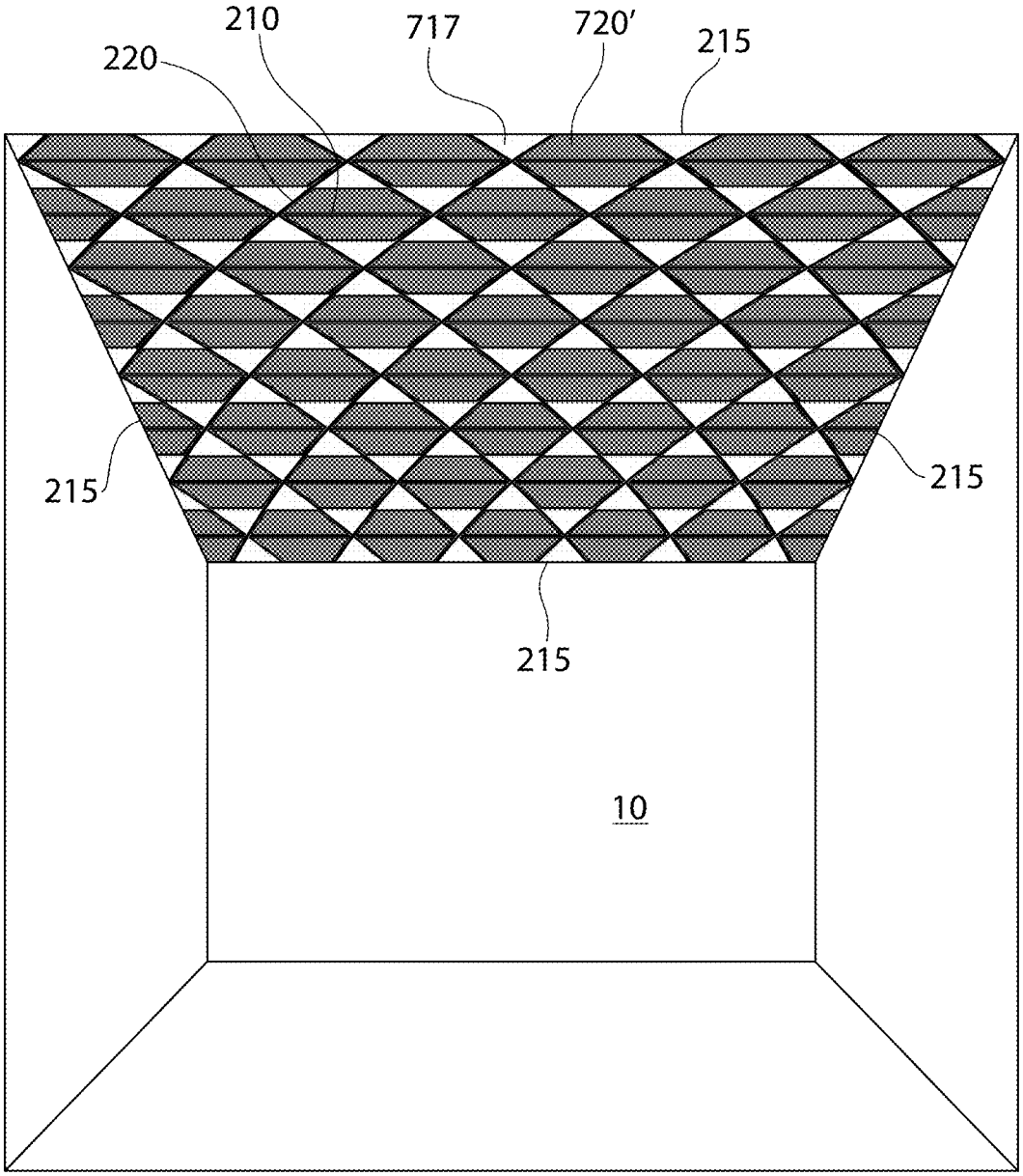
FIG. 18 is a perspective view of ceiling system in accordance with exemplary embodiments of the invention.
Figure 19:
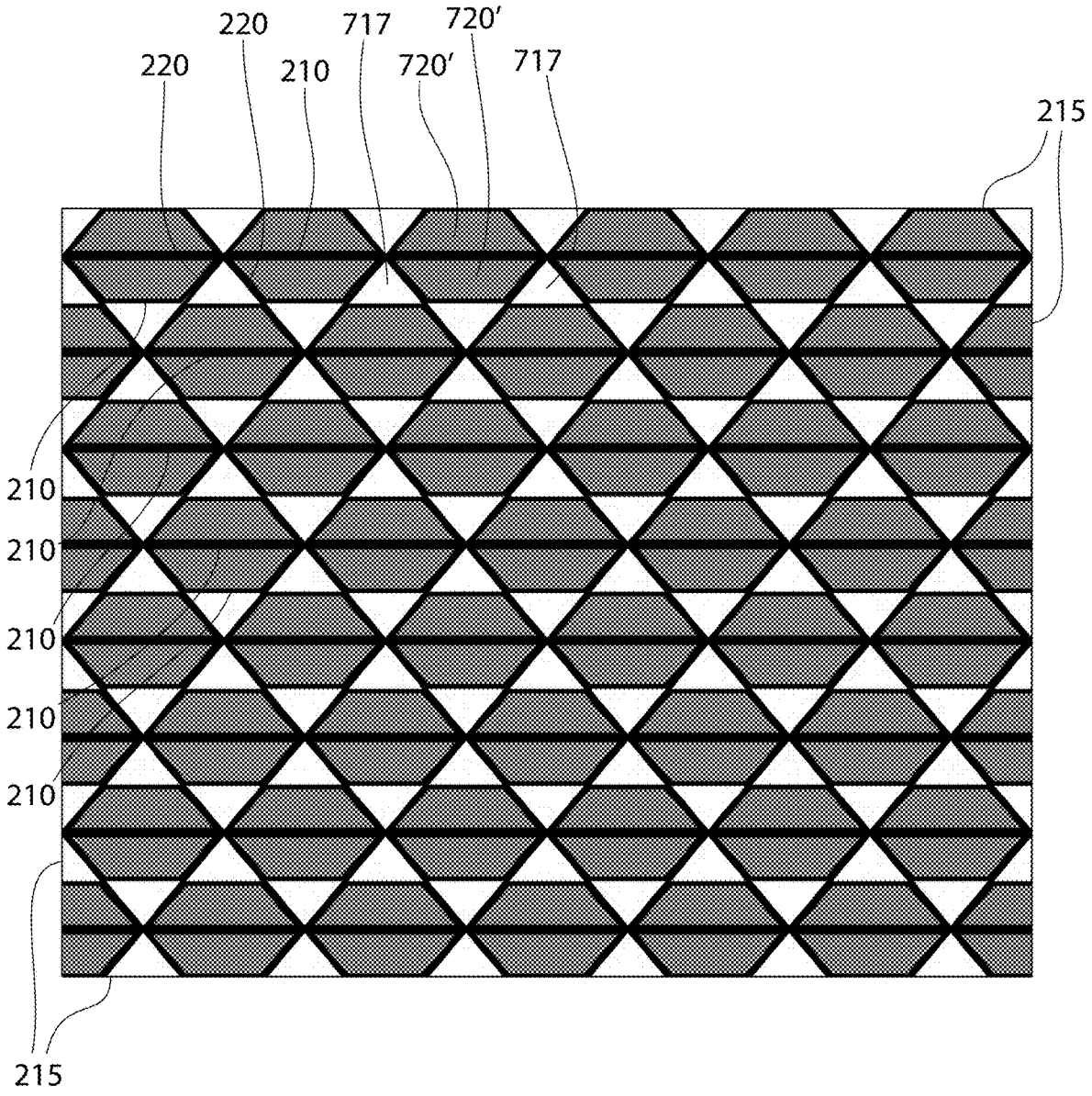
FIG. 19 is a plan view of the ceiling system shown in FIG. 18.

FIGS. 18 and 19 show an example of a ceiling system in accordance with embodiments of the invention. In this example, the entire ceiling is formed by a grid that includes a plurality of parallel main beams 210 and a plurality of cross members 220 bridging the space between main beams 210. The ceiling has perimeter members 215 at each wall to form the perimeter of the ceiling. In this example, two of the perimeter members 215 are parallel to main beams 210, and two of the perimeter members 215 are perpendicular to, and run across the ends of, main beams 210. The pattern shown in FIGS. 18 and 19 includes only two different shape ceiling tiles and one color/shade of each shape. Triangle shaped ceiling tiles 717 are a light color/shade, and trapezoid shaped ceiling tiles 720' are a medium color/shade. In this example, cross members 220 intersect main beams 210 at a nominal 60 degree angle and alternating directions. Other examples of the grid pattern shown can be used with tiles having more or fewer different colors/shades and or different textures. The different colors/shades can be achieved using paints, dyes, stains, films, fabrics, or other coloring techniques or colored materials.

Figure 20:
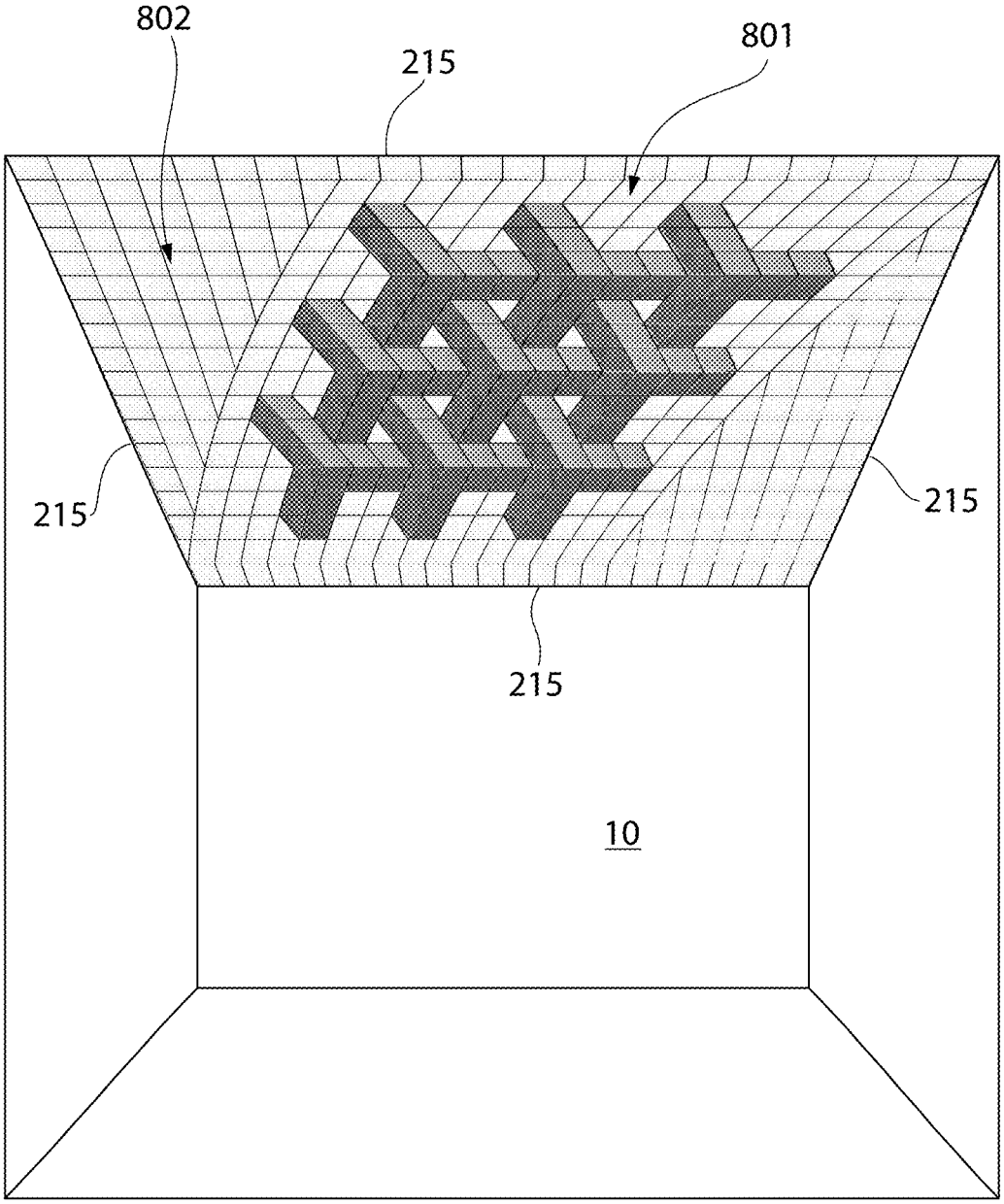
FIG. 20 is a perspective view of ceiling system in accordance with exemplary embodiments of the invention.
Figure 21:
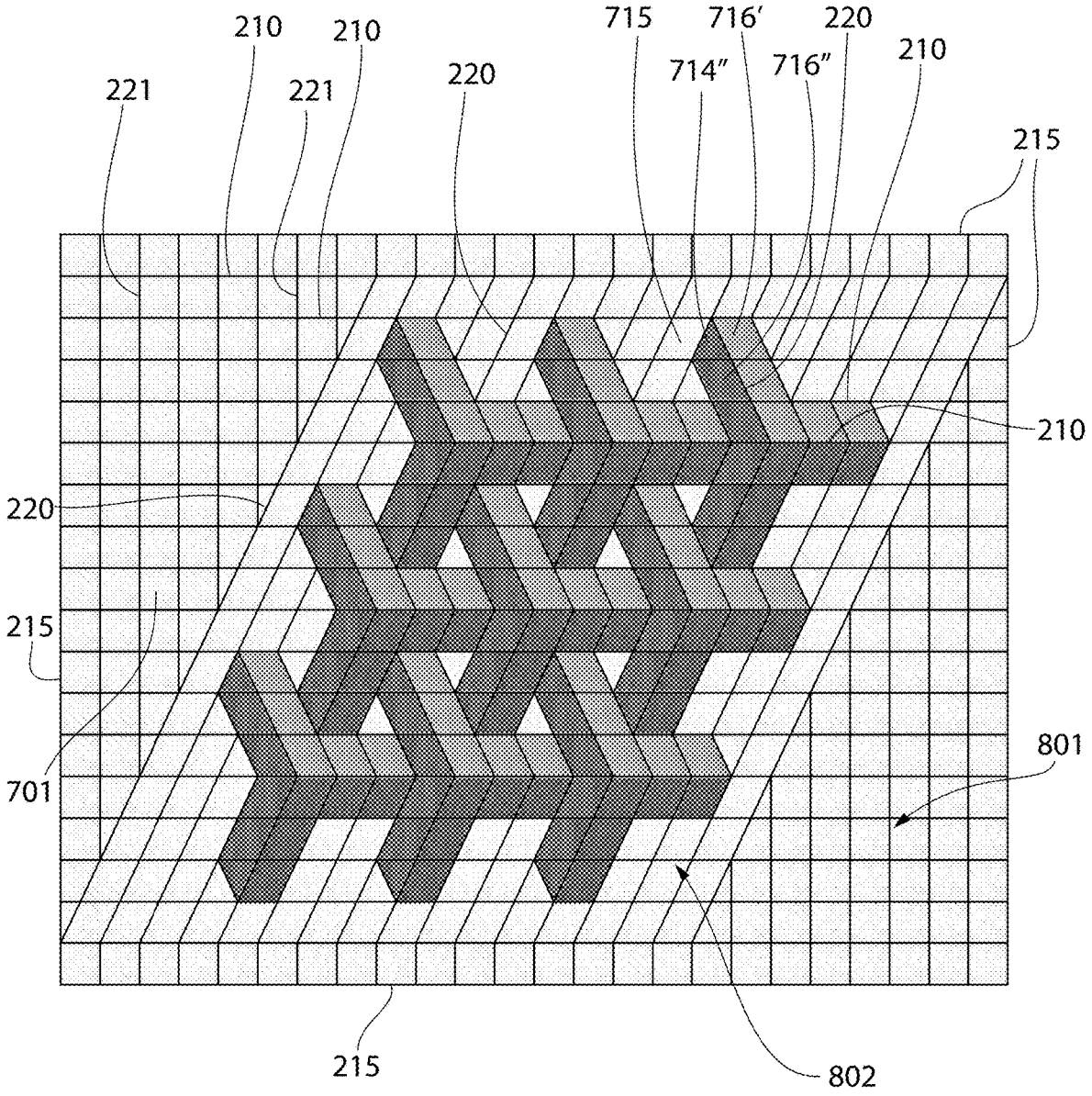
FIG. 21 is a plan view of the ceiling system shown in FIG. 20.

FIGS. 20 and 21 show an example of a ceiling system in accordance with embodiments of the invention. In this example, the entire ceiling is formed by a grid that has a field area 802 that is surrounded by a perimeter area 801. The ceiling has perimeter members 215 at each wall to form the perimeter of the ceiling. In this example, two of the perimeter members 215 are parallel to main beams 210, and two of the perimeter members 215 are perpendicular to, and run across the ends of, main beams 210. Perimeter area 801 has a grid system that has equally spaced parallel main beams 210 and equally spaced cross members 221 that together form a grid of square openings that receive square ceiling tiles 701. The field area 802 uses the same main beams 210 that extend from perimeter area 801 (running horizontally in the Figure). However, cross members 220 are at a different angle than cross members 221 in order to support ceiling tiles that are other than square or rectangular. The interesting design shown in the field area 802 includes triangles 714, 714" and parallelograms 715, 716',716". At some locations where field area 802 abuts perimeter area 801, special shaped ceiling tiles are required. These special shaped tiles can be cut from square ceiling tiles 701 (or other tiles) in the field, or can be made to shape prior to shipping to the installation site. In this example, cross member 220 intersect main beams 210 at a nominal 60 degree angle. This configuration gives a special visual appearance by setting the field area apart from the perimeter area. Other examples of the grid pattern shown can be used with tiles having more or fewer different colors/shades and or different textures. The different colors/shades can be achieved using paints, dyes, stains, films, fabrics, or other coloring techniques or colored materials.

Figure 22:
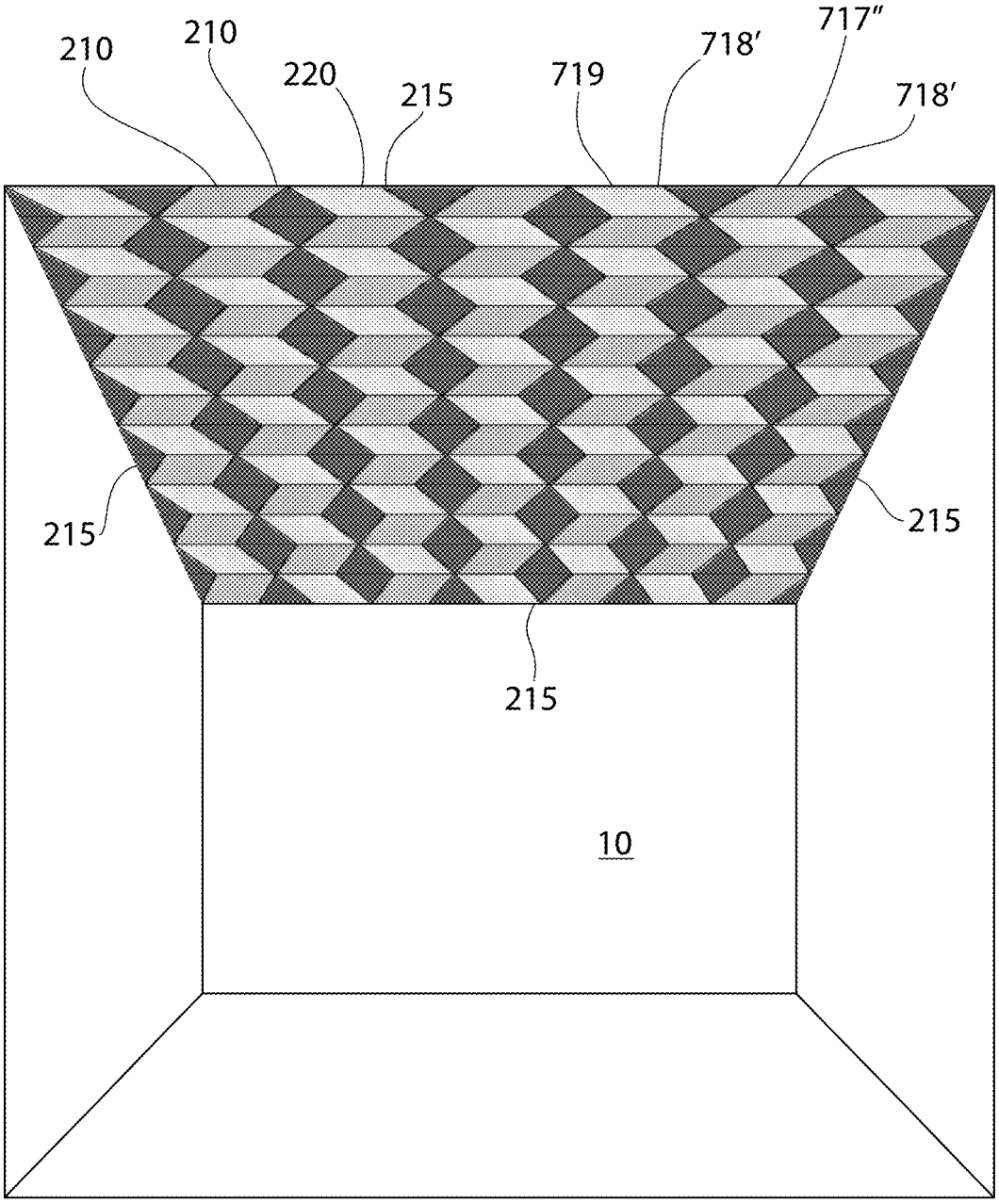
FIG. 22 is a perspective view of ceiling system in accordance with exemplary embodiments of the invention.
Figure 23:
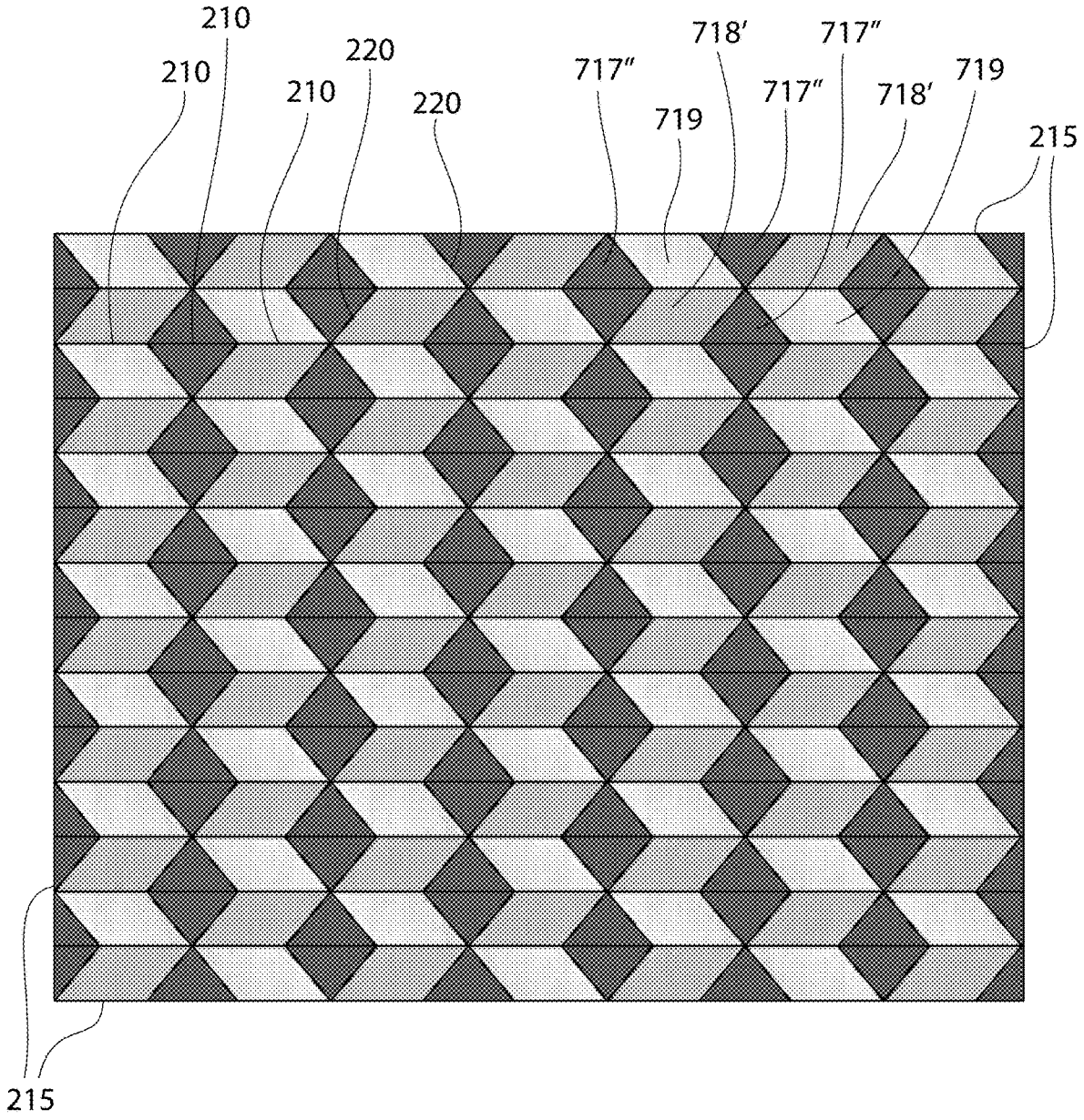
FIG. 23 is a plan view of the ceiling system shown in FIG. 22.

FIGS. 22 and 23 show an example of a ceiling system in accordance with embodiments of the invention. In this example, the entire ceiling is formed by a grid that includes a plurality of parallel main beams 210 and a plurality of cross members 220 bridging the space between main beams 210. The ceiling has perimeter members 215 at each wall to form the perimeter of the ceiling. In this example, two of the perimeter members 215 are parallel to main beams 210, and two of the perimeter members 215 are perpendicular to, and run across the ends of, main beams 210. The pattern shown in FIGS. 22 and 23 includes only two different shape ceiling tiles, one color/shade of one shape and two colors/shades of the other shape. Triangle shaped ceiling tiles 717" are a dark color/shade, parallelogram shaped ceiling tiles 719 are a light color/shade, and parallelogram shaped ceiling tiles 718' are a medium color/shade. In this example, cross members 220 intersect main beams 210 at a nominal 60 degree angle and are follow two intersecting sets of parallel lines. This is only one example of how using non-uniform spacing/angles of cross members 220 can allow different patterns. This example also shows conditions where two cross members 220 intersect a main beam 210 from both sides at a particular location, and conditions where four cross members 220 intersect one main beam 210 at a particular location. Other examples of the grid pattern shown can be used with tiles having more or fewer different colors/shades and or different textures. The different colors/shades can be achieved using paints, dyes, stains, films, fabrics, or other coloring techniques or colored materials.

Figure 24:
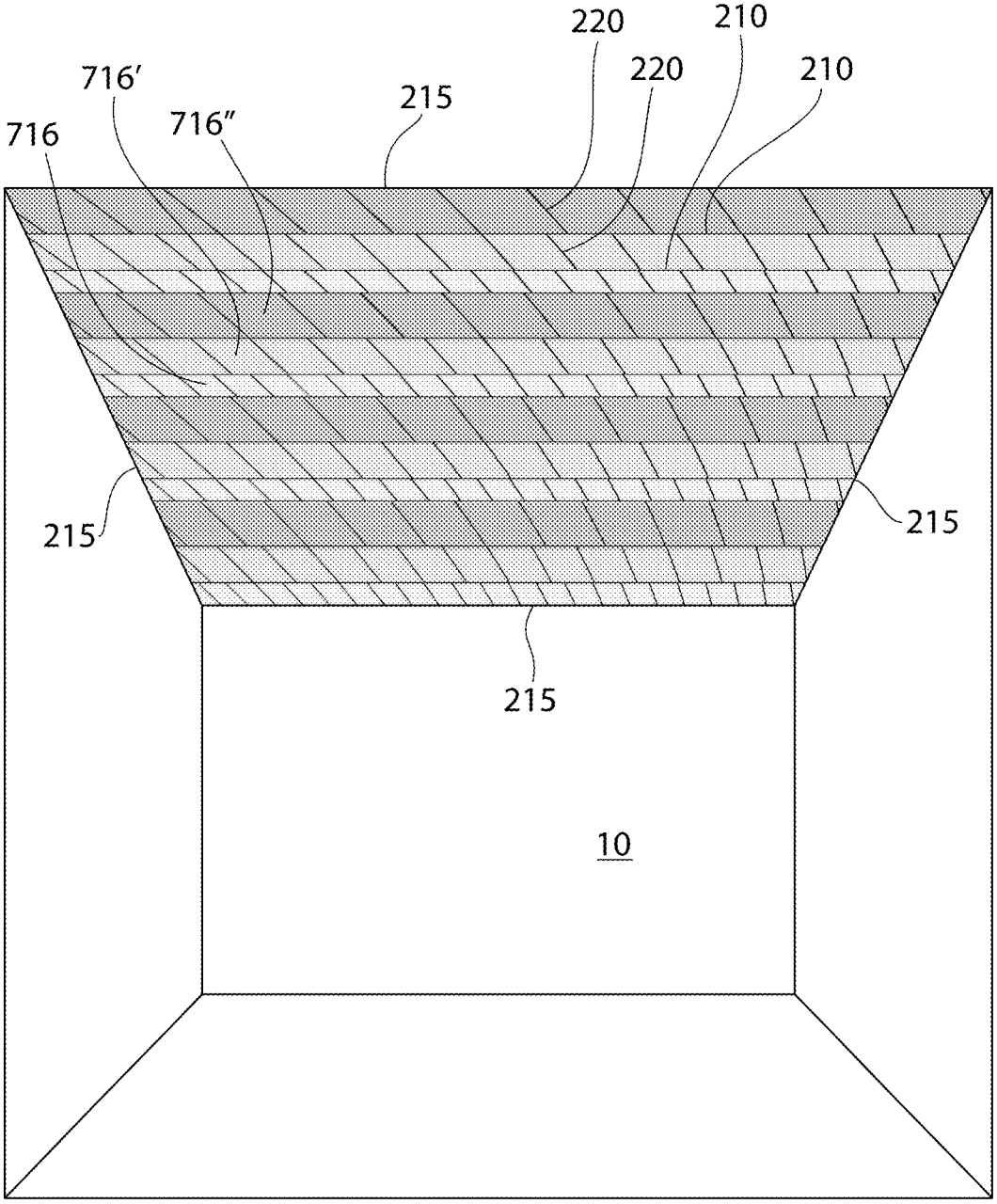
FIG. 24 is a perspective view of ceiling system in accordance with exemplary embodiments of the invention.
Figure 25:
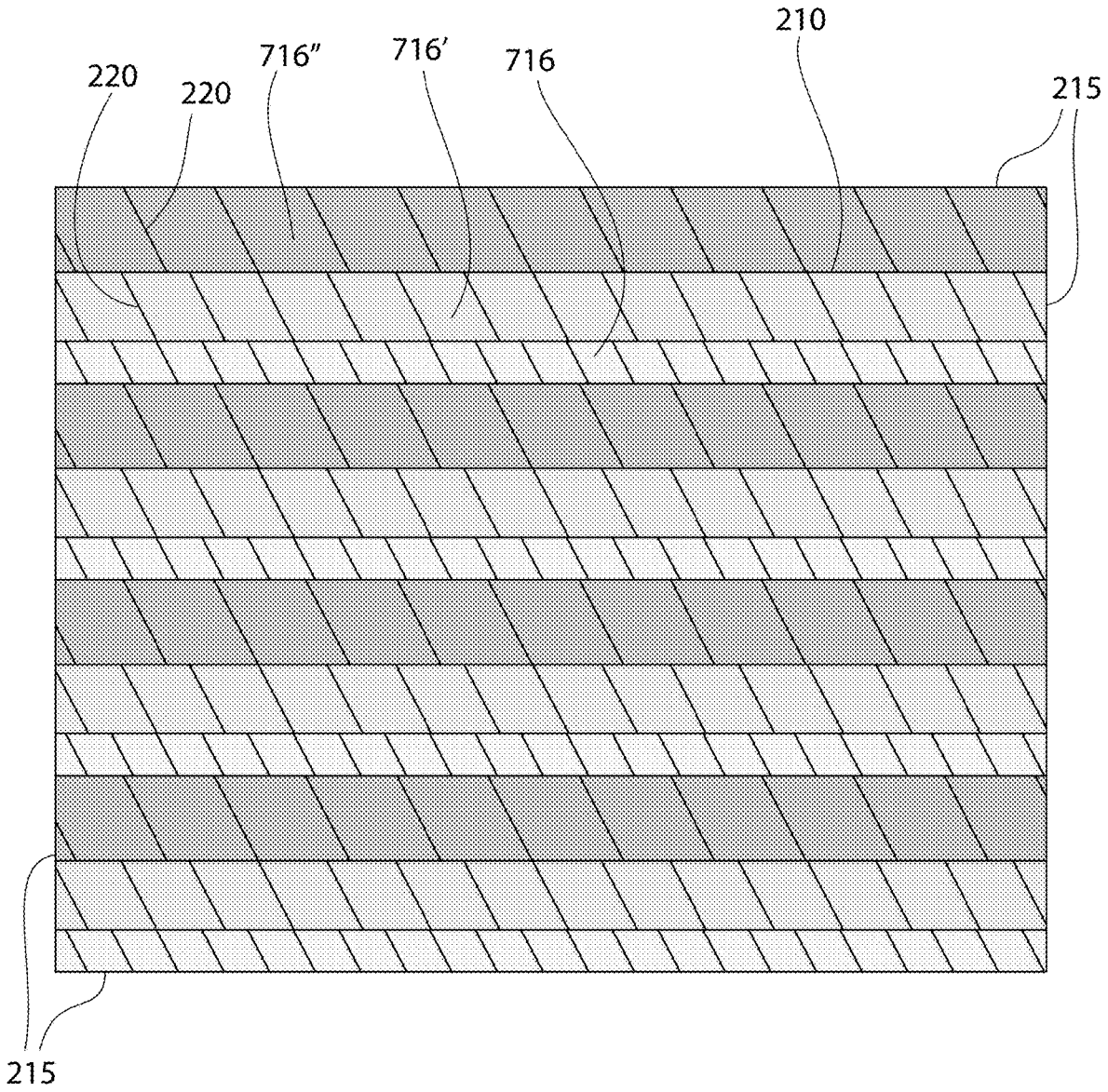
FIG. 25 is a plan view of the ceiling system shown in FIG. 24.

FIGS. 24 and 25 show an example of a ceiling system in accordance with embodiments of the invention. In this example, the entire ceiling is formed by a grid that includes a plurality of parallel main beams 210 and a plurality of cross members 220 bridging the space between main beams 210. The ceiling has perimeter members 215 at each wall to form the perimeter of the ceiling. In this example, two of the perimeter members 215 are parallel to main beams 210, and two of the perimeter members 215 are perpendicular to, and run across the ends of, main beams 210. The pattern shown in FIGS. 24 and 25 includes only one shape ceiling tile, three sizes of that shape, and one color/shade of each size. Small parallelogram shaped ceiling tiles 716 are a light color/shade, medium sized parallelogram shaped ceiling tiles 716' are a medium color/shade, and large parallelogram shaped ceiling tiles 716" are a dark color/shade. In this example, all cross members 220 are parallel and intersect main beams 210 at a nominal 60 degree angle and are spaced differing distances from each other depending on what size ceiling tile is to be used at that location. This is only one example of how using non-uniform spacing of cross members 220 can allow different patterns. This example also shows conditions where two cross members 220 intersect a main beam 210 from both sides at a particular location, and conditions where only one cross member 220 intersects a main beam 210 at a particular location. Other examples of the grid pattern shown can be used with tiles having more or fewer different colors/shades and or different textures. The different colors/shades can be achieved using paints, dyes, stains, films, fabrics, or other coloring techniques or colored materials.

Figure 26:
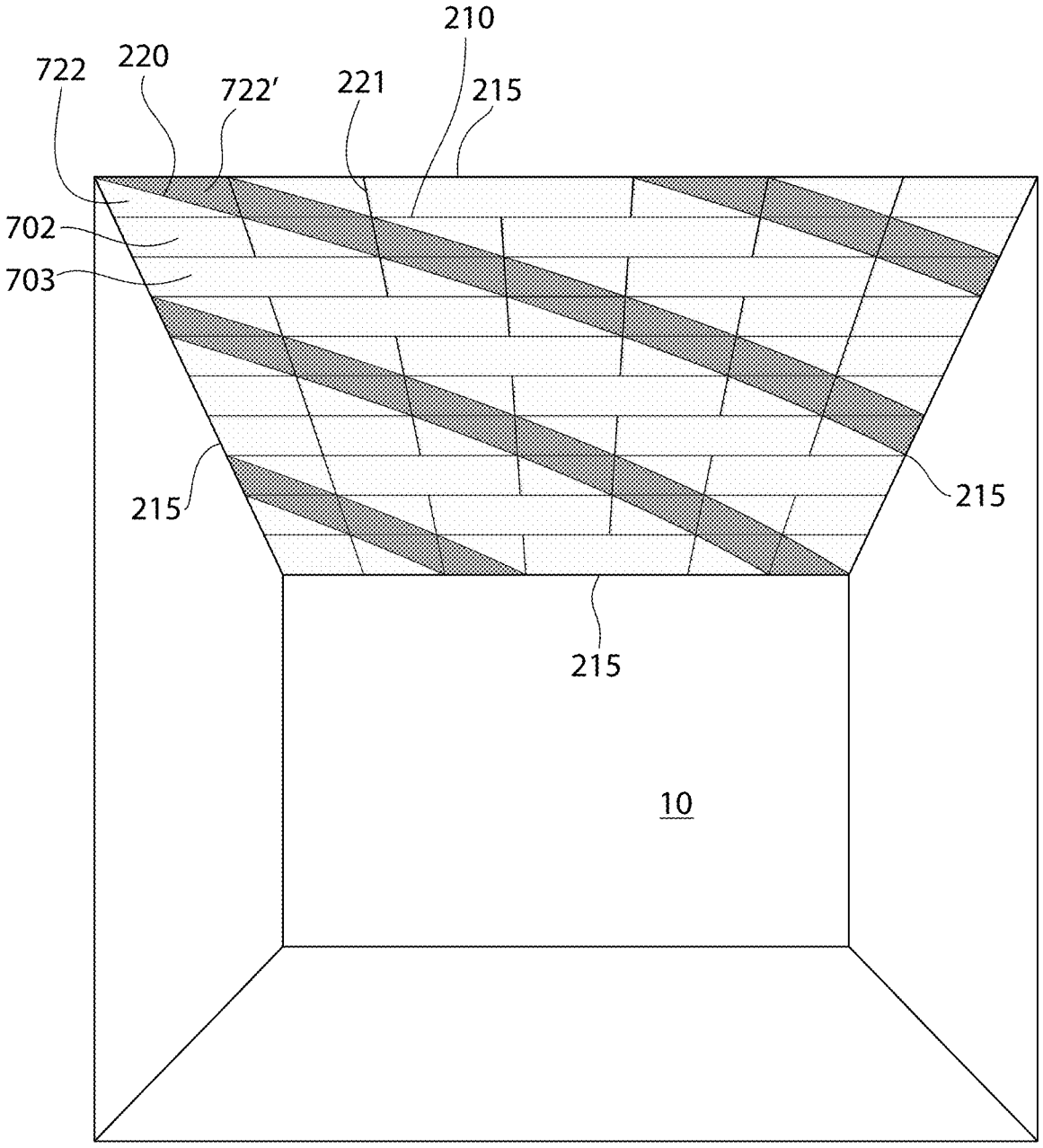
FIG. 26 is a perspective view of ceiling system in accordance with exemplary embodiments of the invention.
Figure 27:
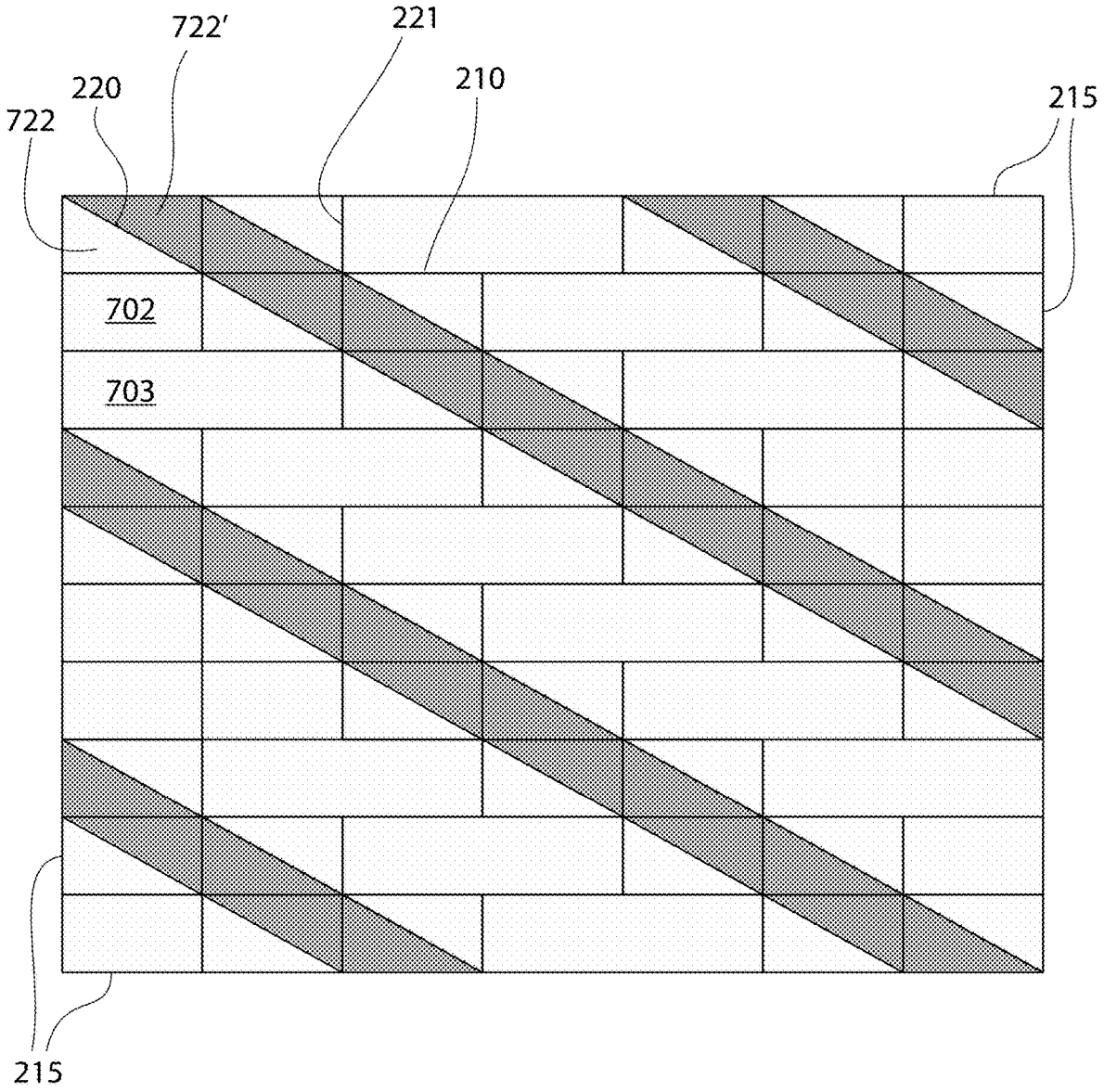
FIG. 27 is a plan view of the ceiling system shown in FIG. 26.

FIGS. 26 and 27 show an example of a ceiling system in accordance with embodiments of the invention. In this example, the entire ceiling is formed by a grid that includes a plurality of parallel main beams 210, and a plurality of cross members 220/221 bridging the space between main beams 210. The ceiling has perimeter members 215 at each wall to form the perimeter of the ceiling. In this example, two of the perimeter members 215 are parallel to main beams 210, and two of the perimeter members 215 are perpendicular to, and run across the ends of, main beams 210. The pattern shown in FIGS. 26 and 27 includes only three different shape ceiling tiles, one color/shade of two of the shapes, and two colors/shades of the other shape. Triangle shaped ceiling tiles 722 are a light color/shade, triangle shaped ceiling tiles 722' are a medium color/shade, short rectangular shaped ceiling tiles 702 are a light color/shade, and long rectangular shaped ceiling tiles 703 are a light color/shade. Cross members 221 intersect main beams 210 at a right angle. In this example, cross members 220 intersect main beams 210 at a nominal 30/60 degree angle to provide support for edges of triangle shaped ceiling tiles 722, 722'. In this case, cross members 220 run parallel to each other and span between two main beams 210. This is only one example of how angled cross members 220 can allow different patterns. This example shows conditions where two cross members 220 intersect a main beam 210 from both sides at a particular location. Other examples of the grid pattern shown can be used with tiles having more or fewer different colors/shades and or different textures. The different colors/shades can be achieved using paints, dyes, stains, films, fabrics, or other coloring techniques or colored materials.

While particular examples of grid layouts and particular sizes, shapes, and colors/shades of ceiling tiles are shown, it is noted that many other grid payouts, tiles shapes, tile sizes, tile colors/shades, and tile patterns can be used and still be within the scope of embodiments of the invention. It is also noted that in cases where main beams and cross members are exposed to the occupiable space, the main beams and cross members can be colored/shaded to enhance the visual appearance of the ceiling design.

While the foregoing description and drawings represent exemplary embodiments of the present disclosure, it will be understood that various additions, modifications and substitutions may be made therein without departing from the spirit and scope and range of equivalents of the accompanying claims. In particular, it will be clear to those skilled in the art that the present invention may be embodied in other forms, structures, arrangements, proportions, sizes, and with other elements, materials, and components, without departing from the spirit or essential characteristics thereof. In addition, numerous variations in the methods/processes described herein may be made within the scope of the present disclosure. One skilled in the art will further appreciate that the embodiments may be used with many modifications of structure, arrangement, proportions, sizes, materials, and components and otherwise, used in the practice of the disclosure, which are particularly adapted to specific environments and operative requirements without departing from the principles described herein. The presently disclosed embodiments are therefore to be considered in all respects as illustrative and not restrictive. The appended claims should be construed broadly, to include other variants and embodiments of the disclosure, which may be made by those skilled in the art without departing from the scope and range of equivalents. In addition, all combinations of any and all of the features described in the disclosure, in any combination, are part of the invention.

What is claimed is:

1. A ceiling system for use in a building space having a plurality of walls, the ceiling system comprising:

a grid system that extends to at least two of the plurality of walls and separates the building space into an occupiable space below the grid system and a plenum space above the grid system; and a plurality of ceiling tiles having a front face opposite a rear face, the plurality of ceiling tiles supported by the grid system; and wherein the grid system and the plurality of ceiling tiles create a barrier between the occupiable space and the plenum space, the plurality of ceiling tiles including three different polygonal non-rectangular ceiling tiles; and wherein the front faces of each of the three different polygonal non-rectangular ceiling tiles are parallel.

2. The ceiling system of claim 1, wherein the plenum space is a closed space.

3. The ceiling system of claim 1, wherein a difference in the three different polygonal non-rectangular ceiling tiles is selected from shape, color, shade of the same color, size, and texture.

4. The ceiling system of claim 1, wherein two of the three different ceiling tiles are different sizes of a first shape, and a third of the three different ceiling tiles is a second shape that is different from the first shape.

5. The ceiling system of claim 1, wherein two of the three different ceiling tiles are different shades of a first color, and a third of the three different ceiling tiles is a second color that is different from the first color.

6. The ceiling system of claim 1, wherein the front face of at least one ceiling tile faces the occupiable space and the back face faces the plenum space, and the front face and the back face are different colors.

7. The ceiling system of claim 1, wherein a portion of the ceiling tiles are tegular ceiling tiles comprising a perimeter portion and a recess formed into the perimeter portion, the recess comprising:

a support surface that is parallel to the front face; and an edge extending between the front face and the support surface;

wherein the front face, the edge, and the support surface are the same color.

8. The ceiling system of claim 1, wherein the grid system has a first main beam;

a second main beam parallel to the first main beam, the first and second main beams extending longitudinally in a main beam direction;

a field area having a plurality of field area cross members that attach to the main beams, the field area cross members intersecting the main beams at a first angle, the first angle being an acute angle; and a perimeter area that surrounds the field area, the perimeter area having a plurality of perimeter area cross members that attach to the main beams, the perimeter area cross members intersecting the main beams at a second angle, the second angle and the first angle being different.

9. The ceiling system of claim 8, wherein the second angle is a right angle.

10. The ceiling system of claim 8, wherein all the perimeter area cross members are parallel to each other and all the field area cross members are parallel to each other.

11. A ceiling system for use in a building space, the ceiling system comprising:

a grid system that separates the building space into an occupiable space below the grid system and a plenum space above the grid system, the grid system comprising at least one main beam and at least one cross beam; and a plurality of tegular ceiling tiles comprising a front face opposite a rear face, a perimeter portion, and a recess formed into the perimeter portion, the recess comprising a support surface that is parallel to the front face;

wherein the support surface of each of the plurality of tegular ceiling tiles rest on at least one of the main beam or the cross beam, and the front face of the plurality of tegular ceiling tiles face the occupiable space; and wherein the grid system and the plurality of ceiling tiles create a barrier between the occupiable space and the plenum space, the plurality of ceiling tiles including three different polygonal non-rectangular ceiling tiles.

12. A ceiling system for use in a building space having a plurality of walls, the ceiling system comprising:

a grid system that extends to at least two of the plurality of walls and separates the building space into an occupiable space below the grid system and a plenum space above the grid system, the grid system having:

a first main beam;

a second main beam parallel to the first main beam, the first and second main beams extending longitudinally in a main beam direction;

a first cross member that interests the first main beam at a first location and intersects the second main beam at a second location; and a second cross member that intersects the second main beam at a third location, the third location being offset from the second location along the main beam direction; and a plurality of ceiling tiles that are supported by the grid system and, with the grid system, create a barrier between the occupiable space and the plenum space, the plurality of ceiling tiles includes three different polygonal non-rectangular ceiling tiles;

wherein all cross members that intersect the second main beam at the second location are on a side of the second main beam that faces the first main beam; and at least one of the first cross member and the second cross member is at an acute angle relative to the main beam direction.

13. The ceiling system of claim 12, wherein the plenum space is a closed space.

14. The ceiling system of claim 12, wherein the second location is offset from the first location along the main beam direction and the first location and the third location are at the same location along the main beam direction.

15. The ceiling system of claim 12, wherein two of the three different ceiling tiles are different sizes of a first shape, and a third of the three different ceiling tiles is a second shape that is different from the first shape.

16. The ceiling system of claim 12, wherein two of the three different ceiling tiles are different shades of a first color, and a third of the three different ceiling tiles is a second color that is different from the first color.

17. The ceiling system of claim 12, wherein the grid system has a field area having a plurality of field area cross members that attach to the main beams, the field area cross members intersecting the main beams at a first angle, the first angle being an acute angle, and a perimeter area that surrounds the field area, the perimeter area having a plurality of perimeter area cross members that attach to the main beams, the perimeter area cross members intersecting the main beams at a second angle, the second angle and the first angle being different.

18. The ceiling system of claim 12, wherein one of the ceiling tiles has a front face that faces the occupiable space and a back face that faces the plenum space, and the front face and the back face are different colors.

19. The ceiling system of claim 12, wherein a portion of the ceiling tiles are tegular ceiling tiles comprising a front face opposite a rear face, a perimeter portion and a recess formed into the perimeter portion, the recess comprising:

a support surface that is parallel to the front face; and an edge extending between the front face and the support surface;

wherein the front face, the edge, and the support surface are the same color.

* * * * *